US006630028B2

(12) United States Patent
Briese et al.

(10) Patent No.: US 6,630,028 B2
(45) Date of Patent: Oct. 7, 2003

(54) CONTROLLED DISPENSING OF MATERIAL

(75) Inventors: William A. Briese, Hinckley, OH (US); Timothy Bryan McGlinchy, Twinsburg, OH (US)

(73) Assignee: Glass Equipment Development, Inc., Twinsburg, OH (US)

( * ) Notice: Subject to any disclaimer, the term of this patent is extended or adjusted under 35 U.S.C. 154(b) by 330 days.

(21) Appl. No.: 09/733,272

(22) Filed: Dec. 8, 2000

(65) Prior Publication Data

US 2002/0069823 A1 Jun. 13, 2002

(51) Int. Cl.[7] ..... B05C 5/02

(52) U.S. Cl. ..... 118/683; 118/684; 118/686; 118/692; 118/712; 118/315; 118/324; 156/578

(58) Field of Search ..... 118/683, 684, 118/686, 692, 709, 712, 315, 324; 156/109, 555, 578

(56) References Cited

U.S. PATENT DOCUMENTS

| | | | | |
|---|---|---|---|---|
| 3,280,523 A | | 10/1966 | Stroud et al. | |
| 4,088,522 A | * | 5/1978 | Mercier et al. | 156/107 |
| 4,145,237 A | * | 3/1979 | Mercier et al. | 156/107 |
| 4,530,195 A | | 7/1985 | Leopold | |
| 4,546,723 A | | 10/1985 | Leopold et al. | |
| 4,787,332 A | | 11/1988 | Geisel et al. | 118/692 |
| 5,044,309 A | * | 9/1991 | Crumbach et al. | 118/419 |
| 5,105,591 A | | 4/1992 | Leopold | |
| 5,136,974 A | * | 8/1992 | Lisec | 118/673 |
| 5,295,292 A | | 3/1994 | Leopold | |
| 5,361,476 A | | 11/1994 | Leopold | |
| 5,932,062 A | * | 8/1999 | Manser | 156/357 |
| 6,197,231 B1 | * | 3/2001 | Lisec | 264/40.1 |
| 6,368,408 B1 | * | 4/2002 | Schuler | 118/316 |
| 6,494,245 B1 | * | 12/2002 | Simone | 156/578 |

FOREIGN PATENT DOCUMENTS

EP 0 705 539 1/1996

OTHER PUBLICATIONS

European Search Report, dated Dec. 9, 2002.

* cited by examiner

*Primary Examiner*—Laura Edwards
(74) *Attorney, Agent, or Firm*—Watts Hoffman Co., LPA

(57) ABSTRACT

A system for controlled dispensing of a material onto an elongated window component. A nozzle dispenses the material into contact with a surface of the elongated window component at a delivery site located along a path of travel of the elongated window component. A conveyer moves the elongated window component along the path of travel relative to the nozzle at a controlled speed. A metering pump delivers controlled amounts of the material to the nozzle. A pressurized bulk supply delivers the material to an inlet to the metering pump. A controller regulates the speed of the metering pump to control the flow rate of the material dispensed by the nozzle.

21 Claims, 13 Drawing Sheets

AIR MOTOR
CONTROL
VALVE
MOTOR
14
12
10
16
20
24
26
28
30
32
34
36
37
38
40
42
44
46
48
50
52
54
56
58a
58b
60
62
64
66
67a
67b
68
72
74
76
78
80
82
84
86
88
90
92
94
96
98
100
102
104
106
107a
107b
108
112
114
120
128
132a
132b
134
135
138
186
189

SUPERVISOR PC
216
ETHERNET
214
GE 90/30 PLC
212
AIO
DIO
T/C
HSC
PRESSURE SENSORS
62,64,102,104
SOLID STATE RELAYS
HEATERS
TEMPERATURE SENSORS
SPACER DETECTION SENSORS
120,128
DISPENSE VALVE CONTROLS
PC (HMI)
210
RS-232 (8 BIT ASCII)
USB
UPS
234
SERVO DRIVE
230
RS-485 (MODBUS RTU)
226
AC VFD
224
228
CONVEYOR MOTOR
AC VFD
222
98
MATRIX GEAR PUMP MOTOR
AC VFD
220
56
SEALANT GEAR PUMP MOTOR
232
CONVEYOR WIDTH MOTOR

310

312

CONTROLLED DISPENSING OF MATERIAL

FIELD OF THE INVENTION

The present invention relates to insulating glass units and, more particularly, to a method and apparatus for applying adhesive and desiccant to spacer assemblies used in constructing insulating glass units.

BACKGROUND OF THE INVENTION

Insulating glass units (IGU's) are used in windows to reduce heat loss from building interiors during cold weather or to reduce heat gain in building interiors during hot weather. IGU's are typically formed by a spacer assembly that is sandwiched between glass lites. The spacer assembly usually comprises a frame structure that extends peripherally around the unit, an adhesive material that adheres the glass lites to opposite sides of the frame structure, and desiccant in an interior region of the frame structure for absorbing atmospheric moisture within the IGU. The glass lites are flush with or extend slightly outwardly from the spacer assembly. The adhesive is disposed on opposite outer sides of the frame structure about the frame structure periphery, so that the spacer is hermetically sealed to the glass lites. An outer frame surface that defines the spacer periphery may also be coated with sealant, which increases the rigidity of the frame and acts as a moisture barrier.

One type of spacer construction employs a U-shaped, roll formed aluminum or steel elements connected at its end to form a square or rectangular spacer frame. Opposite sides of the frame are covered with an adhesive (e.g., a hot melt material) for securing the frame to the glass lites. The adhesive provides a barrier between atmospheric air and the IGU interior which blocks entry of atmospheric water vapor. Desiccant is deposited in an interior region of the U-shaped frame element. The desiccant is in communication with the air trapped in the IGU interior and removes any entrapped water vapor and thus impedes water vapor from condensing within the IGU. After the water vapor entrapped in the IGU is removed, internal condensation only occurs when the seal between the spacer assembly and the glass lites fails or the glass lites are cracked.

Prior art systems for applying adhesive to outer surfaces of a U-shaped spacer and desiccant to an inner region of the U-shaped spacer are pressure-based systems. Desiccant or adhesive under pressure is supplied from a bulk supply, such as a 55-gallon drum by a piston driven pump. The pressure of the desiccant or adhesive supplied by the piston driven pump is approximately 3500 psi. A hose delivers the desiccant or adhesive in response to actuation of the piston driven pump to an inlet of a compensator. The compensator allows a user to select a desired pressure that will be provided at the outlet of the compensator. Typically, the output from the compensator is between 800 and 1200 psi. When the pressure at the outlet of the compensator is less than the selected pressure, the desiccant or adhesive material under pressure supplied to the inlet of the compensator causes the piston to move from a "closed" position to an "open" position. Movement of the compensator piston to the "open" position allows the material under pressure supplied to the compensator inlet to flow toward the outlet until the pressure at the outlet reaches the selected pressure. When the pressure at the outlet reaches or slightly exceeds the selected pressure, the material under pressure at the outlet of the compensator forces the piston back to the "closed" position, stopping material flow from the compensator inlet to the outlet.

The prior art system includes needle valves that dispense the material into contact with the spacer frame. The needle valves are adjustable by the user to control the flow rate of the desiccant or adhesive. The flow of the desiccant or adhesive material is determined by the orifice size, viscosity and pressure of the material. The pressure of the adhesive or desiccant material is dependent on several variables, including viscosity, temperature, nozzle size, and batch to batch variations of the dispensed material. Because so many variables are involved, the amount of desiccant or adhesive dispensed is subject to a fairly wide fluctuation due to pressure changes that are attributable to various factors mentioned above.

Pressure-based systems require the operator to constantly adjust for flow. Often, an excessive amount of material is dispensed to ensure that under all conditions an adequate amount of material is applied to the spacer frame. If the dispensing system is down for more than a few minutes, the system has to be purged due to an increased viscosity of the desiccant or adhesive that has cooled. The increased viscosity of the material that has been allowed to cool makes it difficult to pass the material through the nozzle and flow material through the system.

DISCLOSURE OF THE INVENTION

The present invention concerns a system for controlled dispensing of a material onto an elongated window component. The system includes a dispensing nozzle, a conveyor, a metering pump, a pressurized bulk supply, and a controller. The nozzle is adapted to dispense material into contact with one or more surfaces of the elongated window component when the window component is at a delivery site located along a path of travel of the elongated window component. The conveyor moves the elongated window component along the path of travel with respect to the nozzle at a controlled rate of speed. The metering pump delivers controlled amounts of the material to the nozzle. The pressurized bulk supply delivers the material to an inlet of the metering pump. The controller regulates the speed of the metering pump to control the flow rate of the dispensed material.

In one embodiment, a pressure transducer monitors the pressure of the material before the material is dispensed from the nozzle. The pressure transducer may be positioned for monitoring pressure at an inlet side of the metering pump. The controller regulates pressure of the material delivered to the metering pump from the bulk supply based on the pressure monitored by the pressure transducer. In this embodiment, the controller includes an output coupled to the bulk supply for adjusting the pressure of the material to minimize a pressure drop between the inlet of the metering pump and the outlet of the metering pump.

One embodiment of the invention is configured to dispense material onto one or more surfaces of a generally U-shaped spacer frame member. In this embodiment, a first nozzle is adapted to dispense desiccant into an interior of the U-shaped spacer frame and a second nozzle is adapted to deliver an adhesive onto an outer surface of the spacer frame. One variation of this embodiment includes three nozzles for delivering adhesive to three outer sides of the U-shaped spacer frame. In another variation of this embodiment one type of material is delivered to the sides of the elongated member by two side nozzles and a different material is applied to the bottom of the member by a third nozzle. This practice is commonly referred to as "co-extruding."

In one embodiment, the metering pump is a gear pump. In one embodiment an optic sensor is included for monitoring movement of the elongated window component along the conveyor. The optical sensor may be coupled to the controller which initiates dispensing of the material through the nozzle onto the elongated window component based on sensed movement of the elongated window component by the optical sensor.

In one embodiment, the elongated window component is a spacer frame and member having a gas bleed hole at a location along the length of the spacer frame. The controller and optical sensor sense a presence of the gas bleed hole and stop dispensing material in a region of the gas bleed hole as the spacer moves along the travel path past a dispensing nozzle. The controller may include a computer interface that allows a user to program parameters relating to dispensing of the material onto the elongated window component. One such parameter that the computer interface allows a user to program is a width of the elongated window component. The controller responds to an entered width parameter by adjusting the controlled amounts of material delivered by the metering pump.

The present invention allows material to be dispensed along a length of an elongated window component in a controlled manner. The elongated window component is moved along the path of travel relative to a material dispensing nozzle at a controlled speed. Material from a bulk supply is delivered to an inlet of a metering pump. The metering pump has an outlet coupled to the nozzle to dispense the material through the nozzle into contact with a surface of the elongated window component. Pressure of the material is monitored with the pressure transducer before the material is dispensed from the nozzle.

The speed of the metering pump is regulated to control the rate of flow of the dispensed material from the nozzle. In one embodiment, pressure of the material delivered to the metering pump from the bulk supply is regulated based on a pressure sensed by the pressure transducer.

In an embodiment, wherein the metering pump is a gear pump, a speed of rotation of the gear pump is controlled to meter controlled amounts of material onto the elongated window component. Dispensing of material from the nozzle may be periodically stopped as a plurality of elongated window components move along a path of travel past the nozzle. Dispensing of material may also be stopped to leave openings along the length of the frames uncovered.

A system for controlled dispensing constructed in accordance with the present invention has several advantages over pressure-based dispensers. The present system is much less sensitive to material viscosity variations that exist between material suppliers and batch-to-batch inconsistencies. The system of the present invention does not require operator adjustments due to temperature and system pressure fluctuations that occur over time. The system of the present invention dispenses precise amounts of desiccant and adhesive. Spacer, desiccant and adhesive waste is greatly reduced during start-up and shutdown periods. Use of the metering pump reduces the effect of pressure spikes from the bulk supply.

Additional features of the invention will become apparent and a fuller understanding obtained by reading the following detailed description in connection with the accompanying drawings.

BEST MODE FOR CARRYING OUT THE INVENTION

Figure 3:
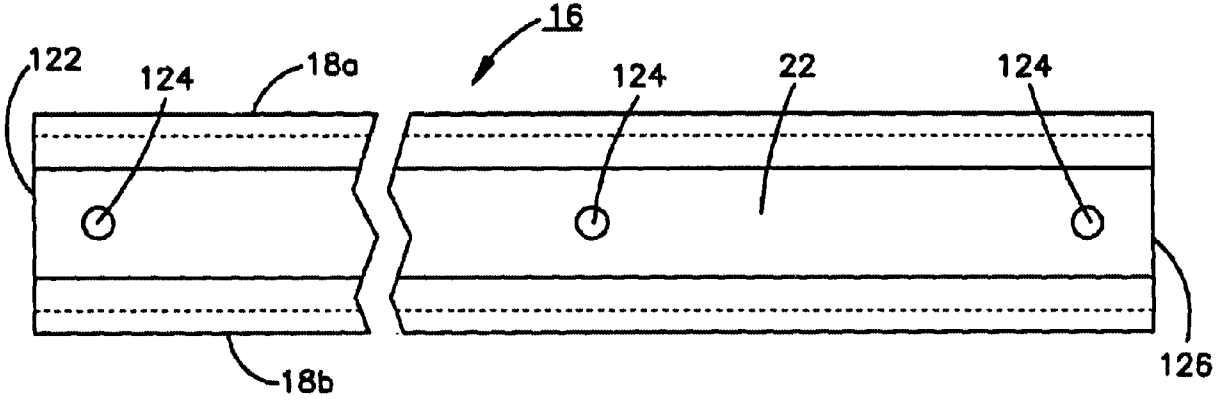
FIG. 3 is a top plan view of an elongate spacer member.
Figure 2:
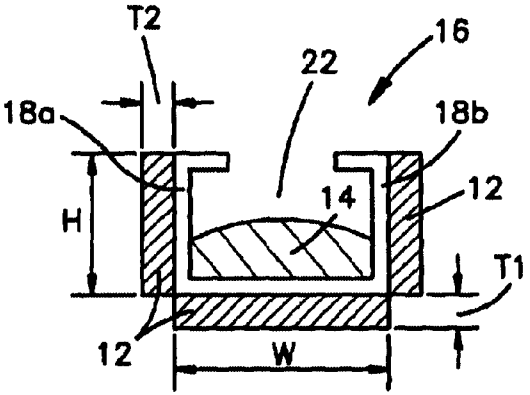
FIG. 2 is a front elevational view of an elongate spacer member with adhesive and desiccant applied to it.

The present invention is directed to a system 10 for controlled dispensing of an adhesive 12 and a desiccant 14 onto an elongated window spacer 16. Referring to FIG. 2, the system 10 applies adhesive 12 to glass abutting walls 18*a*, 18*b* and an outer wall 20 of the elongated window spacer 16. In one embodiment, the system 10 also applies desiccant 14 to an interior region 22 (FIG. 3) of the elongated window spacer 16. The adhesive 12 on the glass abutting walls 18*a*, 18*b* facilitate attachment of glass lites (not shown) of an assembled insulated glass unit. The adhesive 12 on the outer wall 20 strengthens the elongated window spacer 16 and allows for attachment of external structure. The desiccant 14 applied to the interior region 22 of the elongated window spacer 16 captures any moisture that is trapped within an assembled insulating glass unit (not shown). In a second embodiment, desiccant is not applied to the interior region 22 of the spacer 16.

Figure 1:
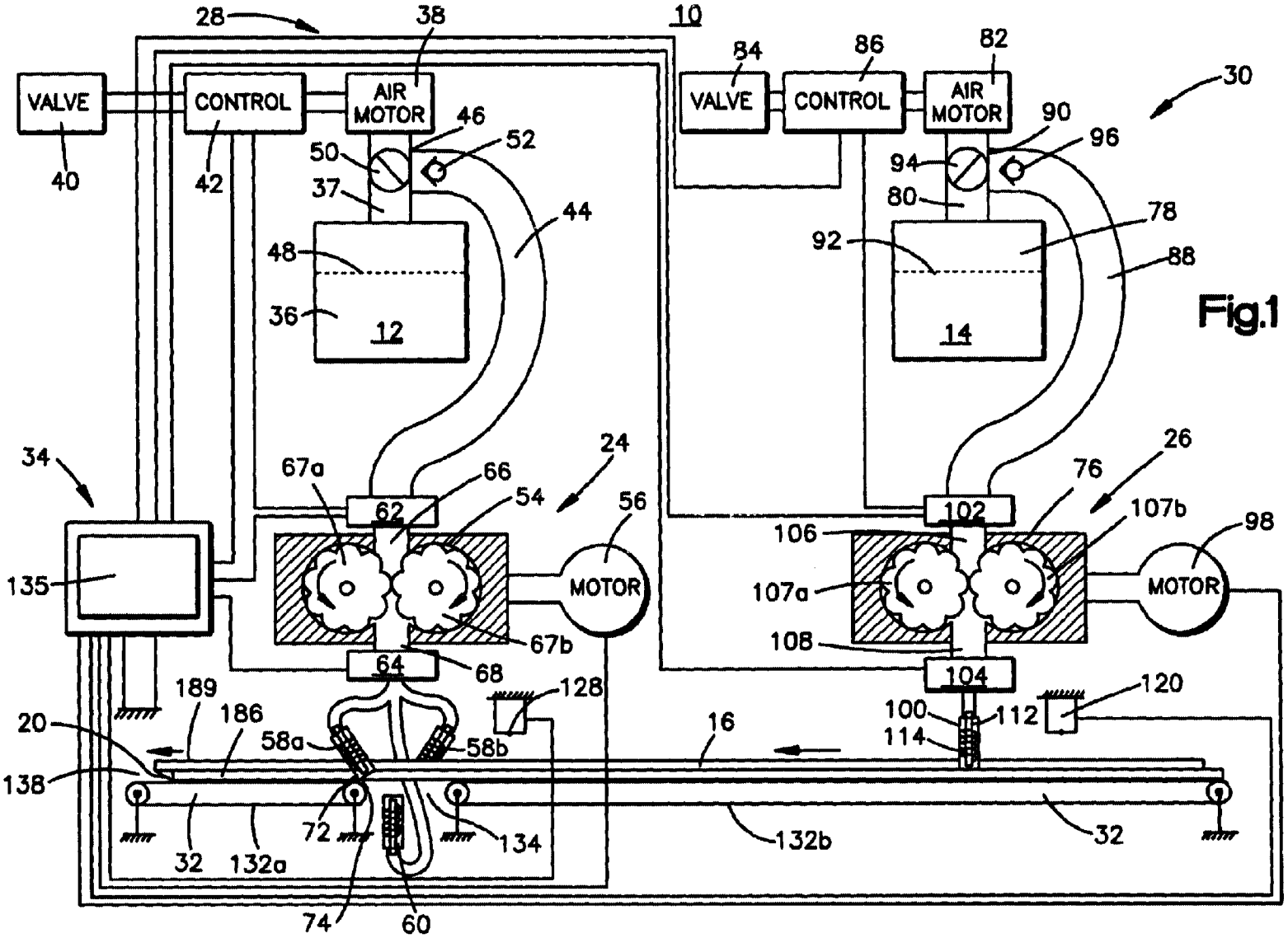
FIG. 1 is a schematic representation of a system for applying adhesive and desiccant to elongate spacer members used in constructing insulating glass units.

Referring to FIG. 1, the dispensing system 10 includes an adhesive metering and dispensing assembly 24, a desiccant metering and dispensing assembly 26, an adhesive bulk supply 28, a desiccant bulk supply 30, a conveyor 32 and a controller 34. The pressurized adhesive bulk supply supplies adhesive 12 under pressure to the adhesive metering and dispensing assembly 24. The desiccant bulk supply 30 supplies desiccant 14 under pressure to the desiccant metering and dispensing assembly 26. The adhesive and desiccant metering and dispensing assemblies 24, 26 each monitor pressure of the desiccant 14 and adhesive 12 supplied by the adhesive and desiccant bulk supplies 28, 30. The controller 34 regulates the pressure of the adhesive 12 and desiccant 14 delivered to the adhesive and desiccant metering and dispensing assemblies 24, 26 based on the pressures sensed by the adhesive and desiccant metering and dispensing assemblies 24, 26. The conveyor 32 moves the elongated window spacer 16 past the adhesive and desiccant metering and dispensing assemblies 24, 26 at a rate of speed controlled by the controller 34.

In the exemplary embodiment, the adhesive metering and dispensing assembly 24 includes an adhesive metering pump 54 which is a gear pump in the exemplary embodiment. The speed of the adhesive dispensing gear pump 54 is controlled to dispense the desired amount of adhesive to the spacer. In the exemplary embodiment the desiccant metering and dispensing assembly 26 includes a desiccant metering gear pump 76 which is a gear pump in the exemplary embodiment. The speed of the desiccant dispensing gear pump 76 is controlled to dispense the desired amount of desiccant to the spacer. The adhesive metering and dispensing assembly 24 applies the desired amount of adhesive 12 to the glass abutment walls 18*a*, 18*b* and outer wall 20 of the elongated window spacer 16 as the elongated window spacer moves along the conveyor 32 past the adhesive metering and dispensing assemblies 24. The desiccant metering and dispensing assembly 26 dispenses the desired amount of desiccant 14 into the interior region 22 of the elongated window spacer 16 as the elongated window spacer 16 is moved past the desiccant metering and dispensing assembly 26 by the conveyor 32.

Referring to FIG. 1, the adhesive bulk supply 28 includes a reservoir 36 filled with adhesive 12, a shovel pump mechanism 37, an air motor 38, an exhaust valve 40, an electropneumatic regulator 42, and a hose 44. Shovel pump mechanisms are well known in the art. One acceptable shovel pump mechanism 37 is model no. MHMP41024SP, produced by Glass Equipment Development. The adhesive electropneumatic regulator 42 regulates the pressure applied to the adhesive 12 by the air motor 38. One acceptable electropneumatic regulator 42 is model no. QB1TFEE100S560-RQ00LD, produced by Proportion-Air. The hose 44 extends from an output 46 of a shovel pump mechanism 37 to an inlet 66 of the adhesive gear pump 54. In the exemplary embodiment, the adhesive reservoir 36 is a 55 gallon drum filled with adhesive 12. One acceptable adhesive is HL-5140, distributed by HB-Fuller. In an alternate embodiment, two bulk supplies 28 are used to allow continued operation of the system 10 while the material reservoir of one of the bulk supplies is being changed.

When the air motor 38 is activated, pistons (not shown) included in the shovel pump mechanism 37 are pushed down into the reservoir 36 by the air motor 38. The shovel pump mechanism 37 includes a plate 48 which forces the material upward into a valving system 50. The shovel pump mechanism 37 delivers adhesive 12 under pressure to the hose 44. In the exemplary embodiment, the shovel pump mechanism 37 heats the adhesive 12 to condition it for the adhesive metering and dispensing assembly 24. However, not all the materials need to be heated. To stop applying additional pressure to the adhesive 12 in the reservoir 36, the exhaust valve 40 is selectively opened on the electropneumatic regulator 42.

Most manufacturing facilities generate approximately 100 psi of air pressure. In the exemplary embodiment, the piston to diameter ratio of the shovel pump mechanism 37 amplifies the air pressure provided by the manufacturing facility by a factor of 42 to 1. Magnification of the facility's available air pressure enables the shovel pump mechanism 37 to supply adhesive 12 at a maximum pressure of 4200 psi to the adhesive hose 44.

In the exemplary embodiment, the adhesive hose 44 is a 1 inch diameter insulated hose and is approximately 10 feet long. The pressure of the adhesive 12 as it passes through the hose 44 will drop approximately 1000 psi as it passes through the hose, resulting in a maximum adhesive pressure of 3200 psi at the inlet of the adhesive metering and dispensing assembly 24. The shovel pump mechanism 37 includes a check valve 52 in the exemplary embodiment. When the pressure of the adhesive 12 supplied by the shovel pump mechanism 37 is greater than the pressure of the adhesive 44 in the hose, the check valve 52 will open, allowing adhesive 12 to escape from the adhesive bulk supply 28 to the hose 44 to reduce the pressure of the adhesive in the bulk supply.

Figure 6A:
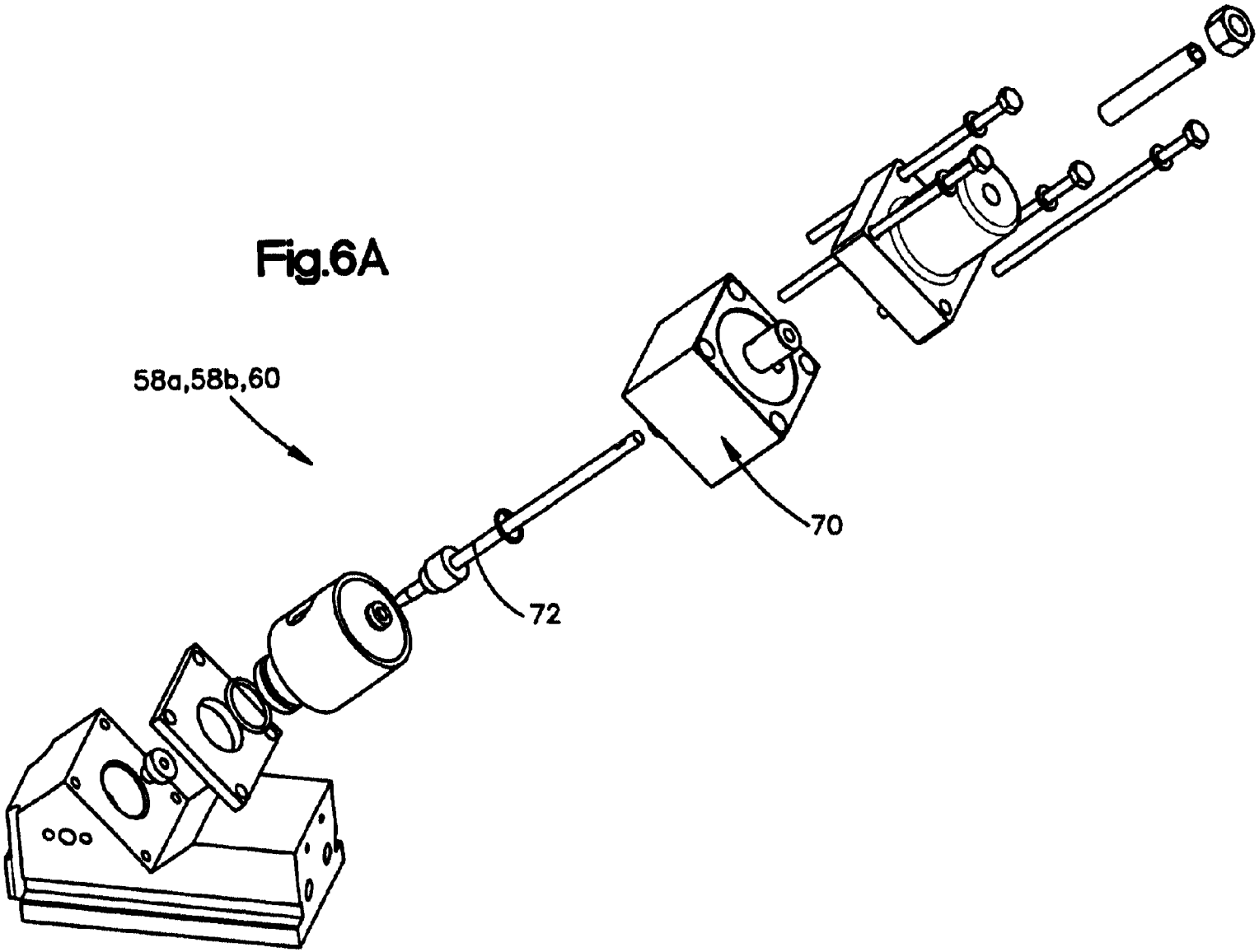
FIG. 6A is an exploded perspective view of an adhesive dispensing gun
Figure 6B:
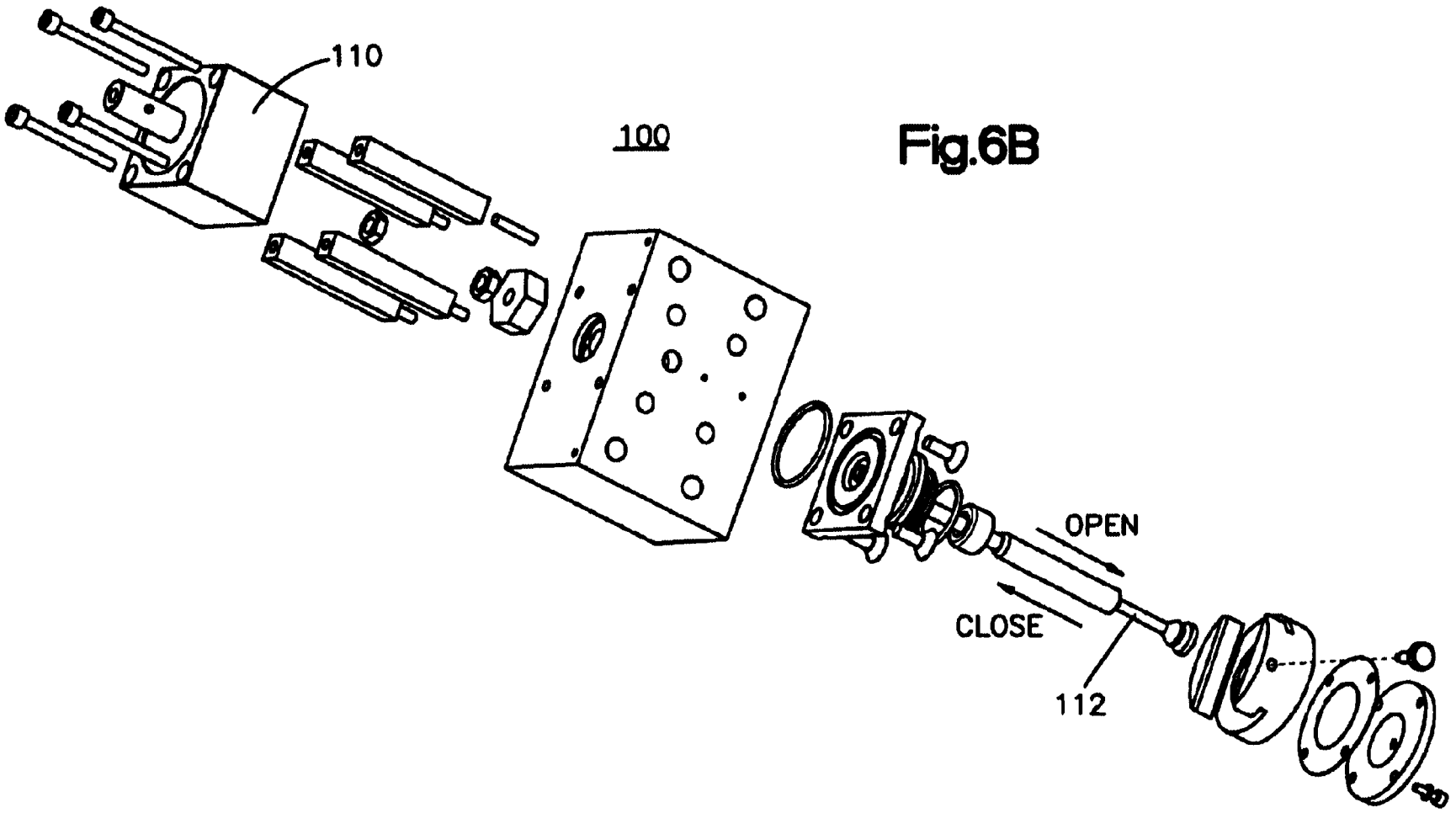
FIG. 6B is an exploded perspective view of a desiccant dispensing gun.
Figure 7:
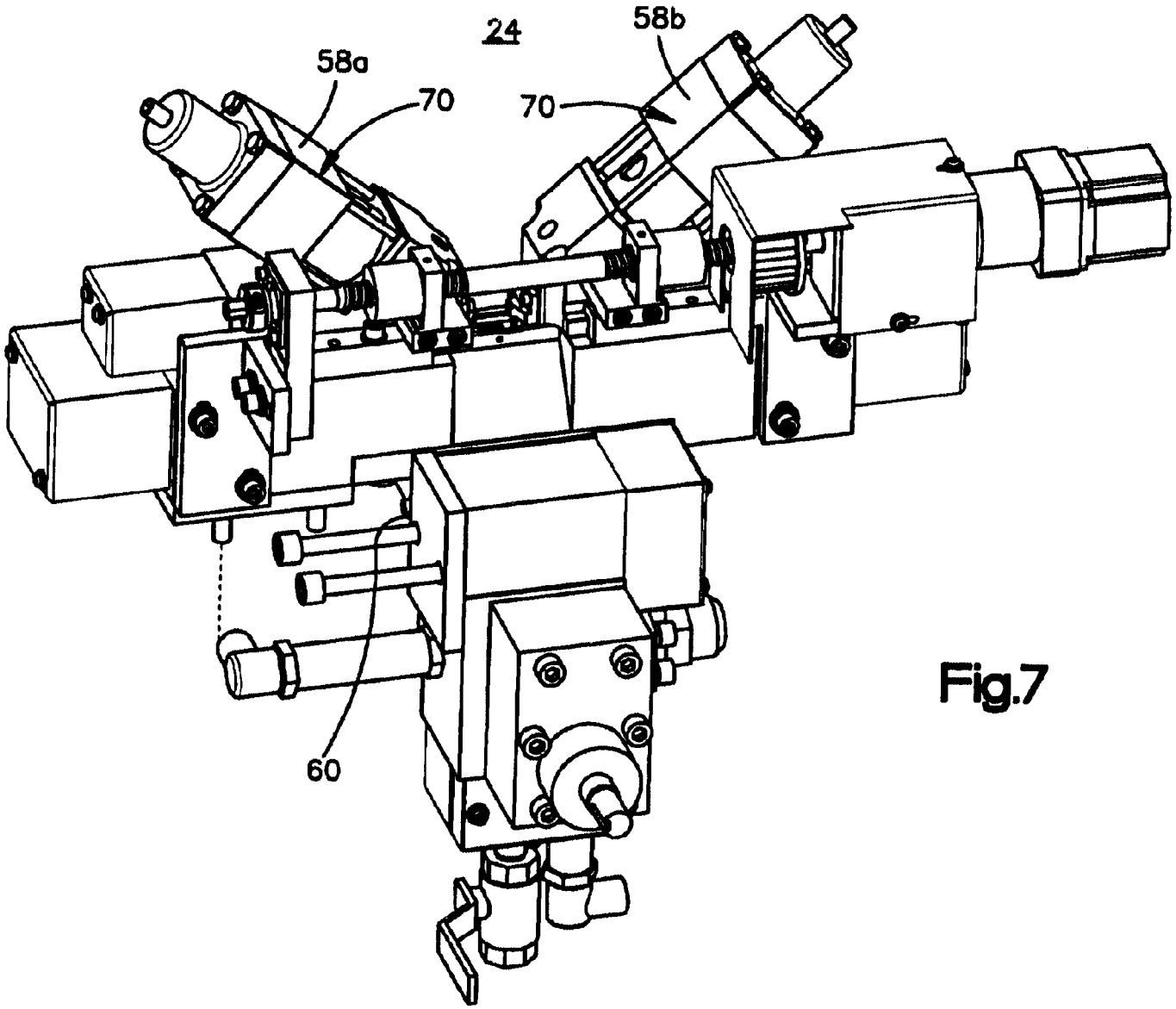
FIG. 7 is a perspective view of an adhesive metering and dispensing assembly.

Referring to FIGS. 1, 6 and 7, the adhesive metering and dispensing assembly 24 includes an adhesive gear pump 54, an adhesive gear pump motor 56, first and second side dispensing guns 58*a*, 58*b*, a bottom dispensing gun 60, an inlet pressure sensor 62 and an outlet pressure sensor 64. Referring to FIG. 1, adhesive 12 is supplied under pressure by the adhesive bulk supply 28 via the hose 44 to an inlet 66 of the adhesive gear pump 54. Controlled rotation of the gears 67*a*, 67*b* of the adhesive gear pump 54 by the motor 56 meters adhesive 12 and supplies the desired amount of adhesive 12 to the dispensing guns 58*a*, 58*b*, 60 through a gear pump outlet 68.

Referring to FIGS. 1, 6A and 7, the adhesive dispensing guns 58*a*, 58*b*, 60 are needle valve-type dispensers that each utilize an air cylinder 70 to apply a force on a stem 72, pushing the stem 72 against a sealing seat (not shown) of a nozzle 74 when the valve is closed. To dispense the adhesive 12, a solenoid valve causes the air cylinder 70 to move the stem 72 away from the sealing seat of the nozzle 74, allowing adhesive 12 to flow through an open orifice of the nozzle 74. One suitable dispensing gun is model no. 2-15210 manufactured by Glass Equipment Development.

Figure 2B:
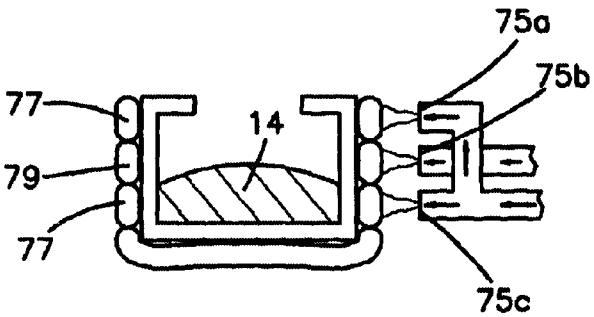
FIG. 2B is a front elevational view of an elongate spacer material with three regions of adhesive and a desiccant applied to it.
Figure 2A:
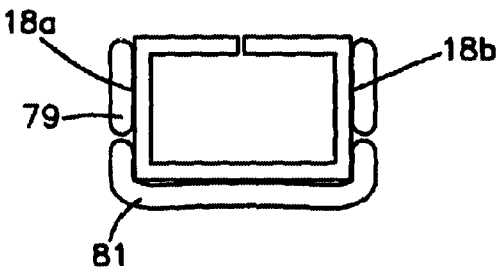
FIG. 2A is a front elevational view of an elongate spacer member with two types of adhesive applied to it.

Referring to FIG. 2A, the side dispensing guns 58*a*, 58*b* apply a polyisobutylene adhesive 79 to the sides 18*a*, 18*b* of the spacer frame 16 in one embodiment. The polyisobutylene material 79 provides a very reliable vapor blocking seal between the sides 18*a*, 18*b* of the spacer 16 and the glass lites (not shown). In this embodiment, bottom adhesive nozzle 74*b* applies a secondary seal material 81, such as polyurethane, polysulfide or silicone. The secondary seal material adds strength to the assembled IGU.

In another embodiment, the side adhesive nozzles are adapted to apply a DSE (Dual Seal Equivalent) material such as TDSE, manufactured by H.B. Fuller, to the sides 18*a*, 18*b* of the spacer 16. In this embodiment, a hot melt material is applied to the bottom surface of the spacer member 16.

In one embodiment, illustrated by FIG. 2B, the side nozzles are adapted to form a triple seal between the spacer 16 and the glass lites (not shown). The side nozzles 74*c* include three orifices 75*a*, 75*b*, 75*c* for blending and applying three types of material to the sides 18*a*, 18*b* of the spacer frame 16. In the exemplary embodiment, a DSE material 77 is applied near the top and bottom of the spacer frame and a polyisobutylene (PIB) material 79 is applied between the segments of DSE The three segments are blended together as they are applied to avoid cracks or voids between the different types of material.

In the exemplary embodiment, the volumetric flow rate of the adhesive 12 dispensed by the adhesive metering and dispensing assembly 24 is precisely controlled by controlling the speed of the adhesive gear pump motor 56, which drives the adhesive gear pump 54. As long as material is continuously supplied to the inlet of the gear pump 54, a known amount of adhesive 12 is dispensed for every revolution of the gear pump 54. In the exemplary embodiment, the adhesive metering and dispensing assembly 24 includes a manifold (not shown) which delivers the adhesive 12 from the hose 44 to the gear pump 54 and delivers the adhesive 12 from the gear pump 54 to the dispensing guns 58*a*, 58*b*, 60 (see FIG. 6A). In the exemplary embodiment, the gear pump 54 provides 20 cm of adhesive 12 per revolution of the gear pump. One suitable gear pump is model no. BAS-20, manufactured by Kawasaki.

Depending on the adhesive selected, the pressure of the adhesive 12 supplied to the gear pump 54 is controlled between approximately 600 psi and 1500 psi. in the exemplary embodiment. If the pressure of the adhesive 12 supplied to the adhesive gear pump 54 is less than approximately 200 psi, the gear pump 54 will have a tendency to cavitate, resulting in voids in the dispensed adhesive 12. If the pressure of the adhesive 12 supplied to the gear pump 54 exceeds approximately 2000 psi, the gear pump 54 or dispensing guns 58*a*, 58*b*, 60 may be damaged.

In the exemplary embodiment, the inlet pressure sensor 62 monitors the pressure of the adhesive 12 at the inlet 66 of the gear pump 54. In the exemplary embodiment, the inlet pressure sensor 62 is model no. 891.23.522, manufactured by WIKA Instrument. The inlet pressure sensor 62 is in communication with the controller 34 which is in communication with the electropneumatic regulator 42 of the adhesive bulk supply 28. The pressure of the adhesive 12 at the inlet 66 of the gear pump 54 quickly drops when adhesive 12 is being dispensed through the nozzle 74. When the adhesive pressure sensed by the inlet pressure sensor 62 is below the desired pressure (typically between 600 psi and 1500 psi) the controller 34 provides a signal to the electropneumatic regulator 42 of the adhesive bulk supply control 42, causing the air motor 38 to apply air pressure to the shovel pump mechanism 37, thereby increasing the pressure of the adhesive 12 supplied by the hose 44 to the inlet 66 of the adhesive gear pump 54. When the pressure of the adhesive 12 at the inlet 66 is greater than the desired pressure, the controller 34 provides a signal to the electropneumatic regulator 41 of the adhesive bulk supply control 42 causing the regulator exhaust valve 40 to vent, thereby preventing the pressure of the adhesive 12 supplied by the hose 44 from increasing further. The pressure of the adhesive 12 is not reduced when the exhaust valve 40 of the regulator 38 is vented. The pressure of the adhesive 12 can only be reduced by dispensing adhesive 12 in the exemplary embodiment.

In an alternate embodiment, the dispensing system 10 minimizes the difference in adhesive pressure between the inlet 66 and outlet 68 of the gear pump 54. In this embodiment, the inlet pressure sensor 62 monitors the pressure of the adhesive 12 at the inlet 66 of the gear pump 54 and the outlet pressure sensor 64 monitors the adhesive pressure 12 at the outlet 68 of the gear pump 54 in one of the adhesive dispensing guns. The signals of the inlet pressure sensor and the outlet pressure sensor are provided to the controller 34. In this embodiment, the controller 34 provides a signal that causes the adhesive bulk supply 28 to increase the pressure of the adhesive 12 supplied when the pressure at the inlet of gear pump 54 is less than the pressure at the outlet of the gear pump 54. The controller 34 provides a signal to the adhesive bulk supply 28 which causes the adhesive bulk supply 28 to stop adding pressure to the adhesive 12 when the pressure at the inlet is greater than the pressure at the outlet.

In the exemplary embodiment, the inlet pressure sensor 62 provides an analog output which ranges from 4 mA to 20 mA to the controller 34. This signal corresponds linearly with an adhesive gear pump 54 inlet pressure range of 0 psi to 2000 psi. If the pressure at the inlet of the adhesive gear pump is lower than a programmed pressure set point, the controller output will apply a voltage signal that causes the pressure of the adhesive at the inlet of the gear pump to increase. The further the actual pressure is from the programmed set point pressure, the more aggressively the voltage signal is applied and the more aggressively pressure is increased at the inlet of the adhesive gear pump. If the pressure sensed at the inlet of the adhesive gear pump is greater than the set point pressure, the adhesive regulator will receive an OV signal and exhaust. For example, the air motor 38 will add pressure to the adhesive 12 much more rapidly in response to a 4 mA inlet pressure sensor signal than to an inlet pressure sensor signal that is slightly less than 12 mA.

In the exemplary embodiment, when the inlet pressure sensor signal is greater than 12 mA, and the corresponding controller signal is less than 5 volts, the electropneumatic regulator 42 will cause the exhaust valve 40 to exhaust in a scaled manner to prevent additional pressure from being created in the adhesive 12. A 20 mA signal and corresponding 0 volt signal provided by the inlet pressure sensor 62 and controller will cause the exhaust valve 40 to exhaust much more quickly than sensor and controller signals which are slightly higher than 12 mA and slightly lower than 5 volts.

Referring to FIG. 1, the desiccant bulk supply 30 includes a desiccant reservoir 78 filled with desiccant 14, a shovel pump mechanism 80, an air motor 82, an exhaust valve 84, an electropneumatic regulator 86, and a hose 88. One acceptable shovel pump mechanism for desiccant is model no. MHMP41042SP, manufactured by Glass Equipment Development. The desiccant electropneumatic regulator 86 regulates the pressure applied to the desiccant 14 by the desiccant air motor 82. One acceptable electropneumatic regulator 86 is model no. QB1TFEE100S560-RQ00LD, produced by Proportion-Air. The hose 88 extends from an outlet of the shovel pump mechanism 80 to an inlet 106 of the desiccant gear pump 76. In the exemplary embodiment, the desiccant reservoir 78 is a 55 gallon drum filled with desiccant 14. In one embodiment, the desiccant is heated before it is applied. One acceptable heated desiccant is HL-5157, produced by H.B. Fuller. In a second embodiment, the desiccant is applied cold (i.e., at room temperature). One acceptable cold desiccant is PRC-525 made by PRC0-Desoto. When the air motor 82 is activated, pistons (not shown) included in the shovel mechanism 80 are pushed down into the reservoir 78 by the air motor 82. The shovel pump mechanism 80 includes a plate 92 which forces the desiccant 14 upward to a valving system 94. The shovel pump mechanism 80 delivers desiccant 14 under pressure to the hose 88. In the exemplary embodiment, the shovel pump mechanism 80 heats the desiccant 14 to condition it for application by the desiccant metering and dispensing assembly 26. To stop additional pressure from being applied to the desiccant 14, the exhaust valve 84 is selectively opened. One acceptable desiccant shovel pump 80 for supplying heated desiccant is model no. MHMP41024SP, produced by Glass Equipment Development. One acceptable pump 80 for supplying cold desiccant is model no. MCFP1031SP, produced by Glass Equipment Development.

As mentioned above, most manufacturing facilities generate approximately 100 psi of air pressure. The piston to diameter ratio of the desiccant shovel pump mechanism 80 amplifies the air pressure provided by the manufacturing facility by a factor of 42 to 1. Magnification of the air pressure provided by the facility enables the shovel pump mechanism 80 to supply desiccant 14 at a maximum pressure of 4200 psi to the desiccant hose 88.

In one embodiment, when heated material is used, the desiccant hose 88 is a 1 inch diameter insulated hose and is approximately 10 feet long. In another embodiment, when cold desiccant is used a 1 inch diameter non-insulated hose is used. The pressure of the desiccant 14 as it passes through the hose 88 will drop approximately 1000 psi as it passes through the hose 88, resulting in a maximum adhesive pressure of 3200 psi at the inlet 106 of the adhesive metering and dispensing assembly 26. The shovel pump mechanism 80 includes a check valve 96 in the exemplary embodiment. When the pressure of the desiccant 14 supplied by the desiccant shovel pump mechanism 80 is greater than the pressure of the desiccant in the hose, the check valve 96 will open, allowing desiccant 14 to escape from the desiccant bulk supply 30 to the hose 88 to relieve pressure in the bulk supply.

Figure 5:
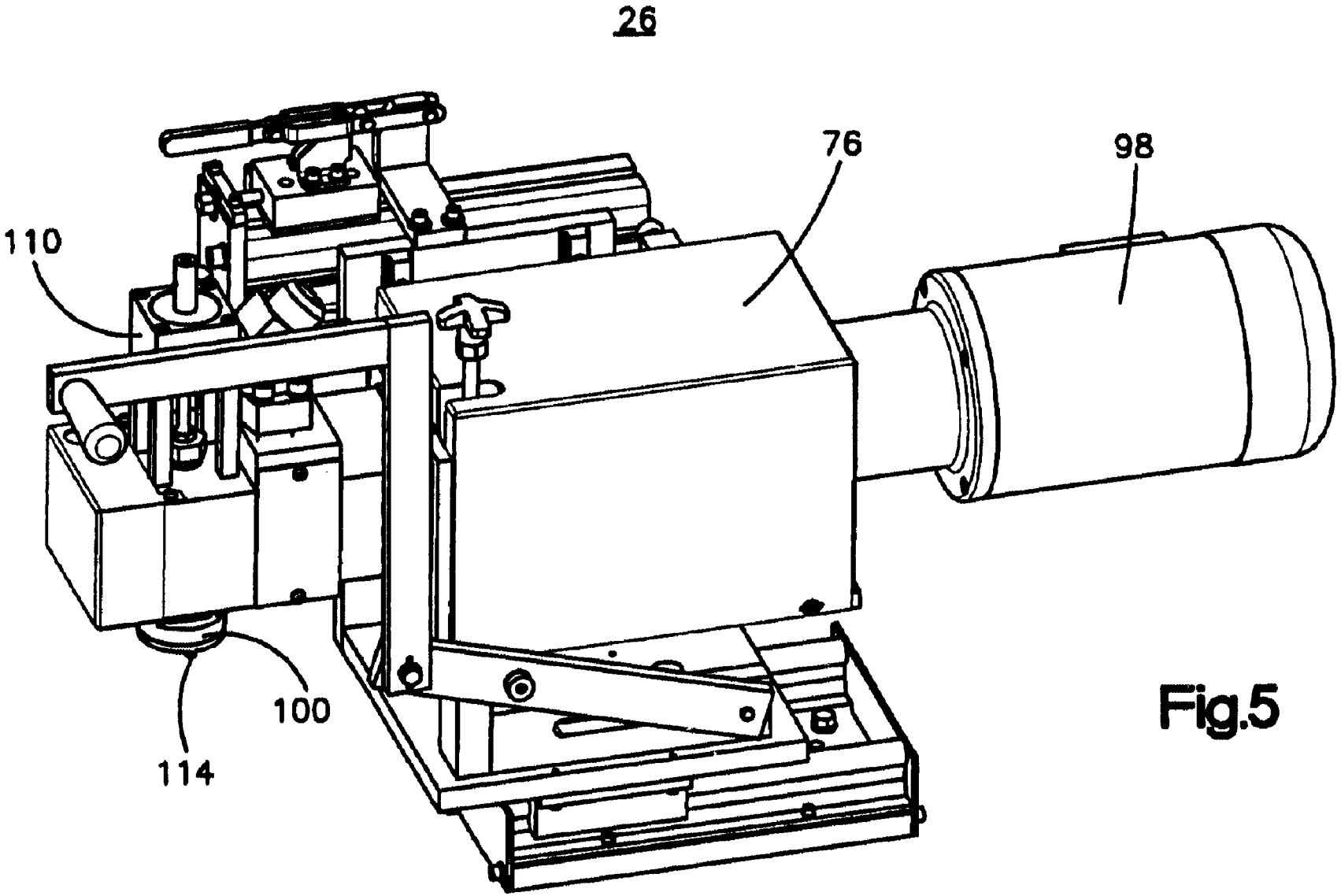
FIG. 5 is a perspective view of a desiccant metering and dispensing assembly.

Referring to FIGS. 1 and 5, the desiccant metering and dispensing assembly 26 includes a desiccant gear pump 76, a desiccant gear pump motor 98, a desiccant dispensing gun 100, an inlet pressure sensor 102 and an outlet pressure sensor 104. Referring to FIG. 1, desiccant 14 is supplied under pressure by the desiccant bulk supply 30 via the hose 88 to the inlet 106 of the desiccant gear pump 76. Controlled rotation of gears 107*a*, 107*b* of the desiccant gear pump 76 by the desiccant gear pump motor 98 meters and supplies desiccant 14 to the desiccant dispensing gun 100 through a desiccant gear pump outlet 108.

Referring to FIGS. 1, 5 and 6B, the desiccant dispensing gun 100 is a snuff-back valve-type dispensing gun that utilizes an air cylinder 110 to apply an upward force on a stem 112 that extends to a nozzle 114 when the needle valve is closed. To dispense desiccant 14, a solenoid valve (not shown) causes the air cylinder 110 to move the desiccant stem 112 away from the air cylinder and a sealing seat of the nozzle 114, allowing desiccant 14 to flow through an open orifice of the nozzle 114. One suitable desiccant dispensing gun 100 is model no. 2-15266, manufactured by Glass Equipment Development.

The volume of desiccant 14 dispensed by the desiccant metering and dispensing assembly 26 can be precisely metered by controlling the speed of the gears 107*a*, 107*b* of the desiccant gear pump motor 98. As long as material is continuously supplied to the inlet of the desiccant gear pump 98, the same volume of desiccant is dispensed for each revolution of the gears 107*a*, 107*b*. In the exemplary embodiment, the desiccant metering and dispensing assembly 26 includes a manifold (not shown) which delivers the desiccant 14 from the hose 88 to the desiccant gear pump 76 and delivers the desiccant 14 from the desiccant gear pump 76 to the desiccant dispensing gun 100. A known amount of desiccant 14 is dispensed for every revolution of the desiccant gear pump 76. In the exemplary embodiment, the desiccant gear pump 76 provides 20 cm; of desiccant 14 per revolution of the desiccant gear pump 76. In the exemplary embodiment, the pressure of desiccant 14 supplied to the desiccant gear pump 76 is maintained between approximately 600 psi and 1500 psi. If the pressure of the desiccant 14 supplied to the desiccant gear pump 76 is less than approximately 200 psi, the desiccant gear pump 76 may cavitate, resulting in voids in dispensed desiccant 14. If the pressure of the desiccant 14 supplied to the desiccant gear pump 76 exceeds approximately 2000 psi, the desiccant gear pump 76 or the desiccant dispensing gun 100 is may be damaged.

In the exemplary embodiment, the desiccant inlet pressure sensor 102 monitors the pressure of desiccant 14 at the inlet 106 of the second gear pump 76. In the exemplary embodiment, the inlet pressure sensor 102 is model no. 891.23.522, manufactured by WIKA Instrument. In the exemplary embodiment, the inlet pressure sensor 102 of the desiccant gear pump 76 is in communication with the controller 34. The pressure of the desiccant 14 at the inlet 106 of the desiccant gear pump 76 drops quickly as the desiccant 14 is dispensed through the nozzle 114. When the pressure sensed by the second inlet pressure sensor 102 is below the desired pressure (typically between 600 psi and 1500 psi) the inlet pressure sensor 102 provides a signal to the controller 34 which in turn provides a signal to the electropneumatic regulator 86 of the desiccant bulk supply control 86. The signal provided to the electropneumatic regulator 86 causes the desiccant air motor 82 to apply air pressure to the shovel pump mechanism 80, thereby increasing the pressure of the desiccant 14 supplied by the hose 88 to the inlet 106 of the desiccant gear pump 76. When the pressure of the desiccant 14 at the inlet 106 of the desiccant gear pump 76 is greater than the desired dispensing pressure (typically 600 psi to 1500 psi), the inlet pressure sensor 102 provides a signal to the controller 34 that provides a signal to the electropneumatic regulator 86. The signal provided to the electropneumatic regulator 86 causes the regulator exhaust valve 84 to vent, thereby preventing the pressure of the desiccant 14 supplied by the hose 88 from further increasing. The pressure of the desiccant 14 is not reduced when the exhaust valve 84 of the air motor 82 is vented, unless the desiccant metering and dispensing assembly 26 is dispensing desiccant 14 or the check valve 96 is opened.

In an alternate embodiment, the dispensing system 10 minimizes the difference in desiccant pressure between the inlet 106 and outlet 108 of the desiccant gear pump 76. In this embodiment, the inlet pressure sensor 102 monitors the pressure of desiccant 14 at the inlet 106 of the desiccant gear pump 76 and the outlet pressure sensor 104 monitors the desiccant pressure at the outlet 108 of the desiccant gear pump 76 or in the dispensing gun 100. The signals from the inlet pressure sensor and the outlet pressure sensor are provided to the controller 34. In this embodiment, the controller 34 provides a signal that causes the desiccant bulk supply 30 to increase the pressure of the desiccant 14 supplied when the pressure at the inlet of the desiccant gear pump 76 is less than the pressure at the outlet 108 of the desiccant gear pump 76. The controller 34 provides a signal to the bulk supply 30 of desiccant 14, causing it to stop adding pressure to the desiccant 14 when the pressure at the inlet 106 is greater than the pressure at the outlet 90 of the second gear pump 76.

In the exemplary embodiment, the inlet pressure sensor 102 provides an analog output which ranges from 4 mA to 20 mA, which corresponds linearly with a desiccant gear pump 76 inlet pressure range of 0 psi to 3000 psi. If the pressure at the inlet of the desiccant gear pump is lower than a programmed inlet pressure set point, the controller output will apply a voltage signal that causes the pressure of the desiccant at the inlet of the gear pump to increase. The further the actual inlet pressure is from the programmed set point pressure, the more aggressively the voltage signal is applied and the more aggressively the pressure is increased at the inlet of the desiccant gear pump. If pressure sensed at the inlet of the desiccant gear pump is greater than the set point pressure, the desiccant regulator will receive an OV signal and exhaust. For example, the air motor 82 will add pressure to the desiccant 14 more rapidly in response to a 4 mA inlet pressure sensor signal 102 than to an inlet pressure sensor signal that is slightly less than 12 mA.

In the exemplary embodiment, when the inlet pressure sensor signal 102 is greater than 12 mA, and the corresponding controller signal is less than 5 volts, the electropneumatic regulator 116 will cause the exhaust valve 84 to exhaust in a scaled manner to prevent additional pressure from being applied to the desiccant 14. A 20 mA signal and corresponding 0 volt signal provided by the inlet pressure sensor 102 and controller 34 will cause the exhaust valve 84 to exhaust much more quickly than signals that are slightly higher than 12 mA and slightly lower than 5 volts.

Figure 4:
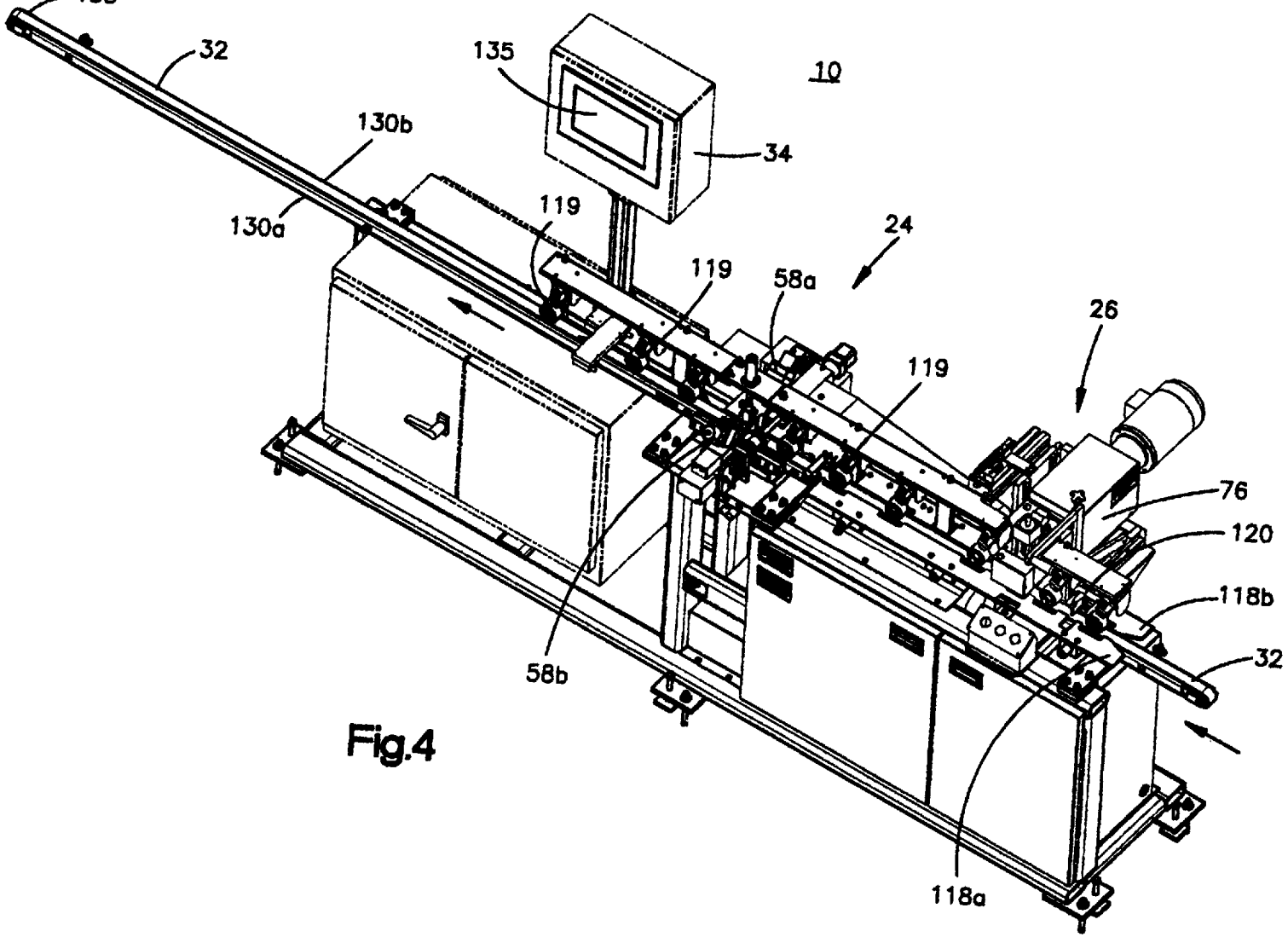
FIG. 4 is a perspective view of a system for applying adhesive and desiccant to spacer assemblies viewed from the front.
Figure 4A:
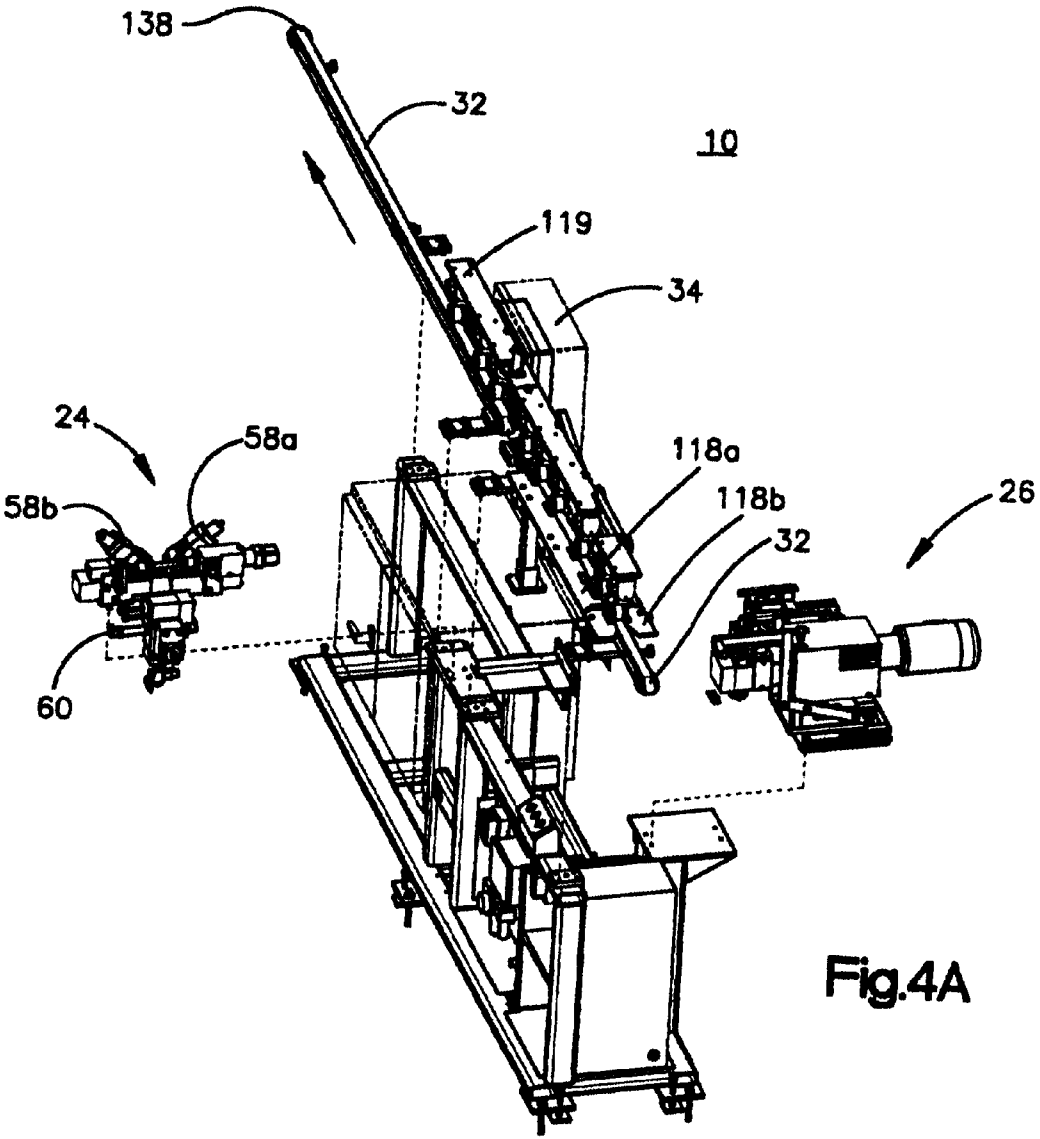
FIG. 4A is an exploded perspective view of an apparatus for applying adhesive and desiccant to elongate spacer members.
Figure 4B:
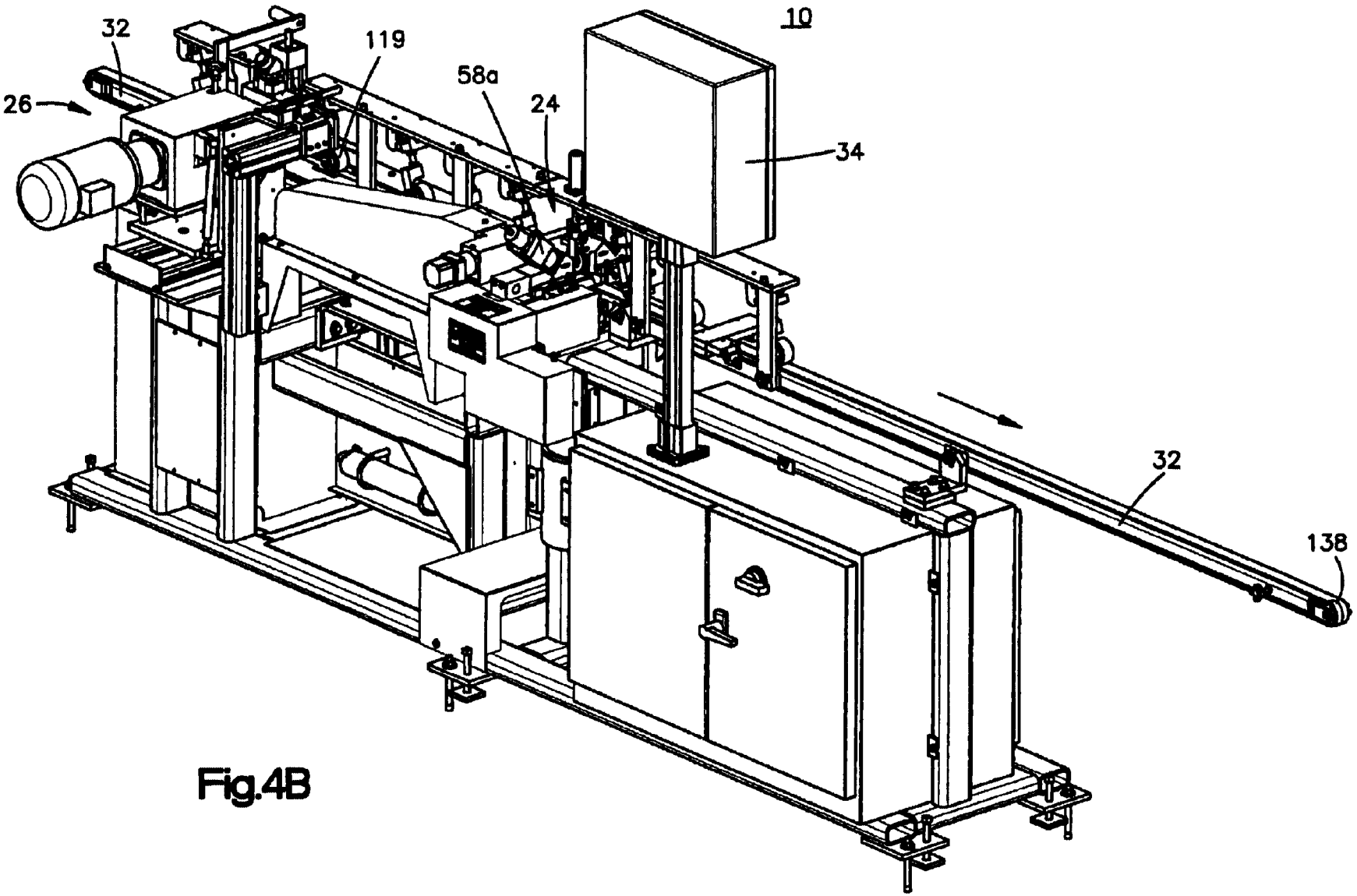
FIG. 4B is a perspective view of an apparatus for applying adhesive and desiccant to elongate spacer members viewed from the rear.

Referring to FIGS. 1 and 4, the conveyor 32 moves elongated window spacers 16 past the desiccant metering and dispensing assembly 26 and adhesive metering and dispensing assembly 24. The desiccant metering and dispensing assembly 26 applies desiccant 14 to an interior region 22 of the elongated window spacer 16 as the conveyor 32 moves the elongated window spacer 16 beneath the nozzle 114 of the desiccant metering and dispensing assembly 26. The adhesive metering and dispensing assembly 24 applies adhesive 12 to the glass abutting wall 18*a*, 18*b* and the outer wall 20 of the elongated window spacer 16 as the elongated window spacer is moved past the nozzles of the adhesive metering and dispensing assembly 24 by the conveyor 32.

The desiccant dispensing gun 100 is located directly above the conveyor 32, allowing desiccant 14 to be dispensed into the interior region 22 of the elongated window spacer 16 as the elongated window spacer moves past the desiccant dispensing gun 100. Referring to FIG. 4, the side dispensing guns 58*a*, 58*b* of the adhesive metering and dispensing assembly 24 are located near sides 130*a*, 130*b* of the conveyor 32 to apply adhesive 12 to the glass abutting walls 18*a*, 18*b* as the elongated window spacer 16 moves past the side dispensing guns 58*a*, 58*b*. Referring to FIG. 1, the conveyor 32 is divided to first and second portions 132*a*, 132*b* with a gap 134 between the first and second conveyor portions 132*a*, 132*b*. The bottom adhesive dispensing gun 60 is located in the gap 134 between the first and second conveyor portions 132*a*, 132*b* below the path of the elongated window spacers 16. The bottom dispensing gun 60 applies adhesive to the outer wall 20 as the elongated window spacer moves along the conveyor 32 past the bottom dispensing gun 60.

Referring to FIG. 4, the adhesive and desiccant dispensing system 10 includes first and second conveyor guides 118*a*, 118*b* which guide the elongated window spacer 16 and position the window spacer in the center of the conveyor 32 as the elongated window spacer moves along the conveyor. The conveyor guides 118*a*, 118*b* are movable toward and away from each other by a servo motor (not shown) to accommodate elongated window spacers 16 of varying width. In the exemplary embodiment, the conveyor guides 118*a*, 118*b* are adjustable to accommodate spacers having widths ranging from 7/32" to 7/8". The dispensing system 10 also includes rolling guides 119 that hold elongated spacers 16 firmly against the conveyor 32 as the spacer is moved along the conveyor. In the exemplary embodiment, the guides include wheels that are forced toward the conveyor by a spring loaded mechanism.

Referring to FIGS. 1 and 4, a pair of desiccant fiber optic sensors 120 is shown mounted in relation to the conveyor 32 at a point along the path of the conveyor 32 before the elongated window spacer 16 reaches the desiccant metering and dispensing assembly 26. In the disclosed embodiment of the invention there are two desiccant fiber optic sensors. The desiccant fiber optic sensors sense a leading edge 122, gas holes 124 and a trailing edge 126 of an elongated window spacer 16 (see FIG. 3). The desiccant fiber optic sensors 120 provide a signal to the controller 34 when the sensor 120 senses a leading edge, a gas hole or the trailing edge of an elongated spacer 16. The controller 34 uses this signal to determine when the elongated spacer 16 will pass under the nozzle 114 of the desiccant metering and dispensing assembly 26. In one embodiment, the controller 34 uses the signal provided by the desiccant fiber optic sensor to determine when the elongated spacer 16 will pass the adhesive nozzles 58*a*, 58*b*, 60 of the adhesive metering and dispensing assembly 24.

In the disclosed embodiment, a pair of adhesive fiber optic sensors 128 is shown positioned in relation to the conveyor 32 at a location along the path of the conveyor 32 before the adhesive metering and dispensing assembly 24. In the exemplary embodiment of the invention this sensor 128 represents a pair of sensors. The adhesive fiber optic sensors 128 sense the leading edge 122, the gas holes 124, and the trailing edge 126 of the elongated window spacer 16. In one embodiment, the adhesive fiber optic sensors "sense" the gas hole by counting the cuts in the spacer that will from the corners of the spacer, since the gas holes may be covered with desiccant. The adhesive fiber optic sensor 128 provides a signal to the controller 34 when the leading edge, gas holes and trailing edge pass beneath the adhesive fiber optic sensor. The controller 34 uses the signal to determine when the leading edge, gas holes and trailing edge of the elongated window spacer 16 will be moved past the adhesive metering and dispensing assembly 24.

Referring to FIGS. 1 and 4, the controller 34 in the exemplary embodiment includes a computer coupled to a touch sensitive display 135 for both inputting parameters and displaying information. The controller 34 controls the speed of the conveyor 32, the pressure supplied by the desiccant bulk supply 30, the pressure supplied by the adhesive bulk supply 28, the speed at which the motor 98 turns the desiccant gear pump 76, the speed at which the motor 56 turns the adhesive gear pump 54, the time at which the desiccant gun 100 dispenses desiccant 14 and the time at which the adhesive guns 58*a*, 58*b*, 60 dispense adhesive 12 as well as other parameters. The user of the controlled adhesive and desiccant dispensing system 10 inputs several parameters via the touch screen 135 of the controller 34. These inputs include the rate of speed of the conveyor 32, the target pressure of desiccant supplied by the desiccant bulk supply, the target pressure of adhesive supplied by the adhesive bulk supply 28, the size of the elongated window spacer 16, the thicknesses of the adhesive 12 applied to the glass abutting walls 18*a*, 18*b* and outer wall 20 of the elongated spacer, the mass per length of elongated window spacer 16 of desiccant 14 to be applied, a gear pump on delay, a gear pump off delay, a gear pump motor acceleration time, and a gear pump motor deceleration time.

By supplying adhesive 12 and desiccant 14 to the gear pumps 54 at an appropriate pressure (typically between 600 psi and 1500 psi) and controlling the speed at which the motors drive the gears of the gear pumps, the volumetric flow rates of desiccant 14 and adhesive 12 are accurately controlled. Referring to FIG. 2, the required volumetric flow of adhesive 12 is calculated by multiplying a cross-sectional area of adhesive 12 applied to the glass abutting walls 18*a*, 18*b* and outer wall 20 of the elongated spacer 16 by the speed at which the conveyor 32 moves. The cross-sectional area of the applied adhesive 12 is equal to the width W of the spacer multiplied by the thickness $T_1$ of adhesive to be applied to the outer wall 20, plus 2 times the height H of the spacer times the thickness $T_2$ of adhesive to be applied to the glass abutting walls 18*a*, 18*b*. The speed at which the adhesive motor 56 must drive the gears 67*a*, 68*b* of the adhesive gear pump 54 in revolutions per second is equal to the calculated required volumetric flow divided by the volume of adhesive provided by the gear pump per revolution of the gear pump.

For example, the cross-sectional area of adhesive applied to an elongated window spacer 16 having a width W of 1 cm, a glass abutting wall, a height H of ½ cm, requiring 0.2 cm adhesive thickness is 0.4 $cm^2$. If the conveyor were moving at 100 cm per second, the required volumetric flow rate provided by the adhesive pump to all three nozzles would be 40 cm per second (the cross-sectional area of 0.4 $cm^2$ times the velocity of the conveyor 32 100 cm per second). If the flow created by the pump per revolution is 20 cm5 per revolution, the required pump speed would be two revolutions per second or the required volumetric flow divided by the flow provided by the pump per revolution.

In one embodiment, when the thickness of the desiccant 14 to be applied to the interior region 22 of the elongated window spacer 16 is inputted to the controller 34 by a touch screen 136. The required volumetric flow and speed at which the desiccant motor 98 drives the desiccant pump 76 is calculated in the same way that the required volumetric flow of adhesive and adhesive motor speed are calculated. The required volumetric flow of desiccant 14 is equal to the cross-sectional area of the desiccant applied multiplied by the velocity of the elongated window spacer 16 along the conveyor 32. The required pump speed is equal to the required volumetric flow of desiccant 14 divided by the volume of desiccant flow produced for each revolution of the desiccant pump 76.

In one embodiment, the mass of the desiccant 14 per length of window spacer 16 is inputted into the controller 34, via the touch screen 136, the controller 34 calculates the required volumetric flow of desiccant 14 by multiplying the inputted mass per elongated window spacer 16 length by the speed of the conveyor 32. The speed at which the desiccant pump 76 must be driven by the desiccant gear pump motor 98 is equal to the required desiccant volumetric flow rate divided by the flow created by each revolution of the desiccant gear pump 76.

There is a short distance (approximately 3") between the desiccant gear pump 76 and the desiccant dispensing gun 100 and between the adhesive gear pump 54 and the adhesive dispensing guns 58*a*, 55*b*, 60 in the exemplary embodiment. The pump on delay field input to the controller 34 is a time delay from when dispensing begins to when rotation of the gear pumps by the motors begins. In the exemplary embodiment, the pump on delay is a negative number (approximately −0.06 seconds) thereby beginning rotation of the gear pumps before the dispensing nozzles are opened. This causes material to flow through the nozzles as soon as the nozzles are opened.

The pump off delay is the time delay between the time when the dispensing nozzles 114 are closed and rotation of the gear pumps by the motor is stopped. In the exemplary embodiment, this number is also a negative number, indicating that the rotation of the gear pumps stops before the nozzles 114 are closed. In the exemplary embodiment, this delay is −0.04 seconds. By stopping the rotation of the gear pumps 54 before the nozzles are closed, excessive pressure at the nozzle is avoided.

In the exemplary embodiment, the motor acceleration and deceleration parameters are input to the controller 34 through the touch screen 135. Motor acceleration is the time required to reach the desired motor speeds. The motor deceleration parameter is inputted to the controller 34 through the touch screen 135. Motor deceleration is the time required to reduce the speed of the gear pump gears to a desired speed or stop the gear pump gears. In the exemplary embodiment, the motor acceleration and motor deceleration times are minimized to maximize the predictability of the flow of adhesive 12 and desiccant 14 through the system. However, the pump acceleration and pump deceleration times cannot be too short or the drive may be faulted.

In the exemplary embodiment, the user of the system enters a user code to the controller 34 via the touch screen 135 which allows the user to configure the adhesive and desiccant dispensing system 10. The user inputs the target pressure of adhesive 12 and desiccant 14 supplied by the bulk supplies 28, 30 through the hoses 44, 88 at the inlets of the gear pump 54. The user inputs the rate of speed of the conveyor, or allows the conveyor to continue at a default speed. The user selects the desired spacer size, ranging from 7/32" to 7/8" in 1/32" increments or 1 mm increments in metric mode. The user selects the thickness of adhesive that is applied to the glass abutting walls 18*a*, 18*b* and the outer wall 20 of the elongated window spacer 16. The user then inputs the weight per a unit length of desiccant or a thickness of desiccant that is applied to the interior region 22 of the elongated window spacer 16. The gear pump on delay and gear pump off delay for each of the gear pumps are entered by the user. The motor acceleration and deceleration times are entered to the controller 34 via the touch screen 136.

The distance between the conveyor guides 118*a*, 118*b* is adjusted by a servo motor in accordance with the size of the spacer inputted by the user. An elongated window spacer 16 is placed on the conveyor 32 (either manually or automatically by an automated delivery device) with the outer wall 20 in contact with the conveyor 32 and the glass abutting walls 18*a*, 18*b* constrained by the conveyor guides 118*a*, 118*b*. The rolling guides 119 hold the elongated spacer 116 firmly against the conveyor 32 as the spacer is moved along the conveyor. The conveyor 32 moves the elongated window spacer 16 toward the desiccant metering and dispensing assembly 26. The leading edge 122, gas holes 124 and trailing edge 126 of the elongated window spacer pass beneath the desiccant fiber optic sensor 120. The desiccant fiber optic sensor 120 senses the leading edge, the gas holes 124 and the trailing edge 126 and provides a signal to the controller 34 indicating the time at which the leading edge, gas holes and trailing edge pass beneath the desiccant fiber optic sensor 120. The controller 34, using the input from the desiccant fiber optic sensor and the speed of the conveyor 32 to calculate the time at which the leading edge, gas holes and trailing edge of the elongated window spacer 16 will pass beneath the nozzle 114 of the desiccant dispensing gun 100.

The elongated window spacer 16 is moved by the conveyor 32 past the desiccant dispensing gun 100. When the leading edge 122 of the elongated window spacer 16 reaches the desiccant dispensing gun 100, the air cylinder 110 of the desiccant dispensing gun 100 opens the desiccant dispensing gun's nozzle by moving the stem 112 to dispense desiccant 14 into the interior region 22 of the elongated spacer beginning at the leading edge. Desiccant 14 is applied to the interior region as the elongated spacer is moved past the desiccant dispensing gun 100. The desiccant gear pump motor 98 drives the desiccant gear pump 76 at the required speed to supply the desired amount of desiccant 14 into the interior region 22 of the elongated window spacer 16. As the desiccant dispensing gun 100 dispenses desiccant 14, the pressure of the desiccant at the inlet 106 of the desiccant gear pump 76 decreases quickly. The desiccant inlet pressure sensor 102 senses the pressure of the desiccant supplied to the inlet 106 of the gear pump and provides a signal to the controller 34 indicative of the pressure of the desiccant at the inlet. When the pressure of the desiccant is less than desired inlet pressure (typically between 600 psi and 1500 psi), the controller 34 provides a signal to the desiccant electropneumatic regulator 86 which causes the air motor 82 to increase the pressure of the desiccant 14 supplied to the inlet 106 of the desiccant gear pump 76.

In one embodiment, when a gas hole 124 of the elongated window spacer 16 passes beneath the desiccant dispensing gun 100, dispensing of desiccant into the interior region 122 is temporarily stopped, leaving the gas holes 124 open. When desiccant dispensing stops, and the air motor cylinder 82 continues to apply pressure to the desiccant, the pressure of the desiccant at the inlet of the desiccant gear pump 76 rises. The desiccant inlet pressure sensor 102 senses the pressure at the inlet of the desiccant gear pump 76 and provides a signal to the controller 34. When the pressure of the desiccant at the inlet 106 of the desiccant gear pump 76 is greater than the desired pressure, a controller 34 provides a signal to the desiccant electropneumatic regulator 86 which causes the exhaust valve 84 to open preventing pressure in the desiccant 14 from increasing. In the exemplary embodiment, the controller 34 causes the desiccant dispensing gun 100 to begin dispensing desiccant again after the gas hole 124 passes the desiccant dispensing gun 100. In an alternate embodiment, desiccant 14 is applied over the gas holes 124. In this embodiment, the controller 34 causes the desiccant dispensing gun 100 to continue dispensing desiccant 14 as each gas hole 124 passes beneath the desiccant dispensing gun 100. This option of applying desiccant over the gas holes, may be programmed by the user into the controller 34 via the touch screen 135.

The desiccant dispensing gun 100 continues to dispense desiccant 14 into the interior region 22 until the trailing edge 126 of the elongated window spacer 16 is reached. In one embodiment, the controller stops dispensing of desiccant 14 at the trailing edge 126 of the elongated window spacer 16 based on the position of the trailing edge 126 sensed by the desiccant fiber optic sensor 120. In an alternate embodiment, the controller 34 stops dispensing of desiccant 14 into the interior region 22 based on a length parameter that is inputted into the controller 34 via the touch screen 135.

Movement of the elongated window spacer 16 is continued along the conveyor 32 to the adhesive fiber optic sensor 128 in the exemplary embodiment. The adhesive fiber optic sensors 128 sense the leading edge 122, the gas holes 124 by sensing and counting spacer corners and the trailing edge 126 of the elongated window spacer 16. The adhesive fiber optic sensor provide a signal to the controller 34 indicating when the leading edge 122, gas holes 124 and trailing edge 126 of the elongated window spacer 16 were sensed by the adhesive fiber optic sensor 128. The controller 34 uses signals provided by the adhesive fiber optic sensor and the speed of the conveyor 32 to determine when the leading edge 122, gas holes 124 and trailing edge 126 of the elongated window spacer 16 will pass the side dispensing guns 58*a*, 58*b* and bottom dispensing gun 60, in the exemplary embodiment. In an alternate embodiment, the system does not include an adhesive fiber optic sensor. In this embodiment, the signals provided by the desiccant fiber optic sensor and the speed of the conveyor are used by the controller to determine when the spacer 16 will pass the adhesive nozzles.

When the leading edge 122 of the elongated window spacer 16 reaches the side dispensing guns 58*a*, 58*b* and the bottom dispensing gun 60, the side dispensing guns 58*a*, 58*b* begin applying adhesive 12 to the glass abutting walls 18*a*, 18*b* and the bottom dispensing gun 60 begins dispensing adhesive 12 to the outer wall 20. The controller 34 causes the gear pump motor 56 to drive the adhesive gear pump 54 at the speed required to dispense the desired thickness of adhesive 12 along the walls of the elongated window spacer 16. The controller 34 causes the air cylinders 70 to move the stems 72 of the adhesive dispensing guns 58*a*, 58*b*, 60 away from the nozzle 74 allowing adhesive to flow through the nozzle 74 and onto the glass abutting walls 18*a*, 18*b* and outer wall 20.

The pressure of the adhesive 12 at the inlet of the adhesive gear pump 54 decreases quickly as the adhesive guns 58*a*, 58*b*, 60 begin to dispense the adhesive. The inlet pressure sensor 62 senses the pressure of the adhesive 12 supplied by the adhesive bulk supply 28 to the inlet 66 of the adhesive gear pump 54. The inlet pressure sensor 62 provides a signal to the controller 34 indicative of the adhesive pressure at the inlet 66 of the adhesive gear pump 54. When the pressure of the adhesive 12 supplied to the inlet 66 of the gear pump 54 is below the desired pressure (typically between 600 psi and 1500 psi) the controller 34 provides a signal to the adhesive electropneumatic regulator 41 that causes the adhesive air motor 38 to add pressure to the adhesive 12.

When the third corner of the spacer travels past the adhesive dispensing guns 58*a*, 58*b*, 60 the controller 34 provides a signal to the bottom dispensing gun 60 which discontinues dispensing of adhesive 12 to the outer wall 20 as the gas hole 124 moves past the bottom dispensing gun 60. In an alternate embodiment, application of adhesive 12 by the bottom dispensing gun 60 is continued as the gas hole 124 moves past the bottom dispensing gun 60.

Adhesive is applied to the walls 18*a*, 18*b*, 20 of the elongated window spacer 16 as the spacer 16 is moved past the adhesive dispensing guns 58*a*, 58*b*, 60. The dispensing is continued until the trailing edge 126 of the elongated window spacer 16 moves past the adhesive dispensing guns 58*a*, 58*b*, 60. When the trailing edge 126 reaches the adhesive dispensing guns 58*a*, 58*b*, 60, the controller 34 provides a signal to the air cylinders 70 of the adhesive dispensing guns 58*a*, 58*b*, 60 moving the stem 72 back into engagement with the nozzle 74 to discontinue dispensing of adhesive. The inlet pressure sensor 62 monitors the pressure of the adhesive at the inlet of the adhesive gear pump 54. When the pressure of the adhesive at the inlet of the adhesive gear pump 54 is greater than the desired pressure (typically between 600 psi and 1500 psi) the controller 34 provides a signal to the adhesive electropneumatic regulator 41 which causes the regulator's exhaust valve 40 to open, preventing additional pressure from being applied to the adhesive 12.

The elongated window spacer 16 with desiccant 14 and adhesive 12 applied to it is moved to the second end 138 of the conveyor 32 where it may be bent into a window spacer frame for assembly into an insulated glass unit.

Alternatively, the elongated window spacer 16 may be moved to another location where is it bent to form a window spacer frame and assembled with glass lites to form an insulated glass unit.

Controller 34

Figure 8:
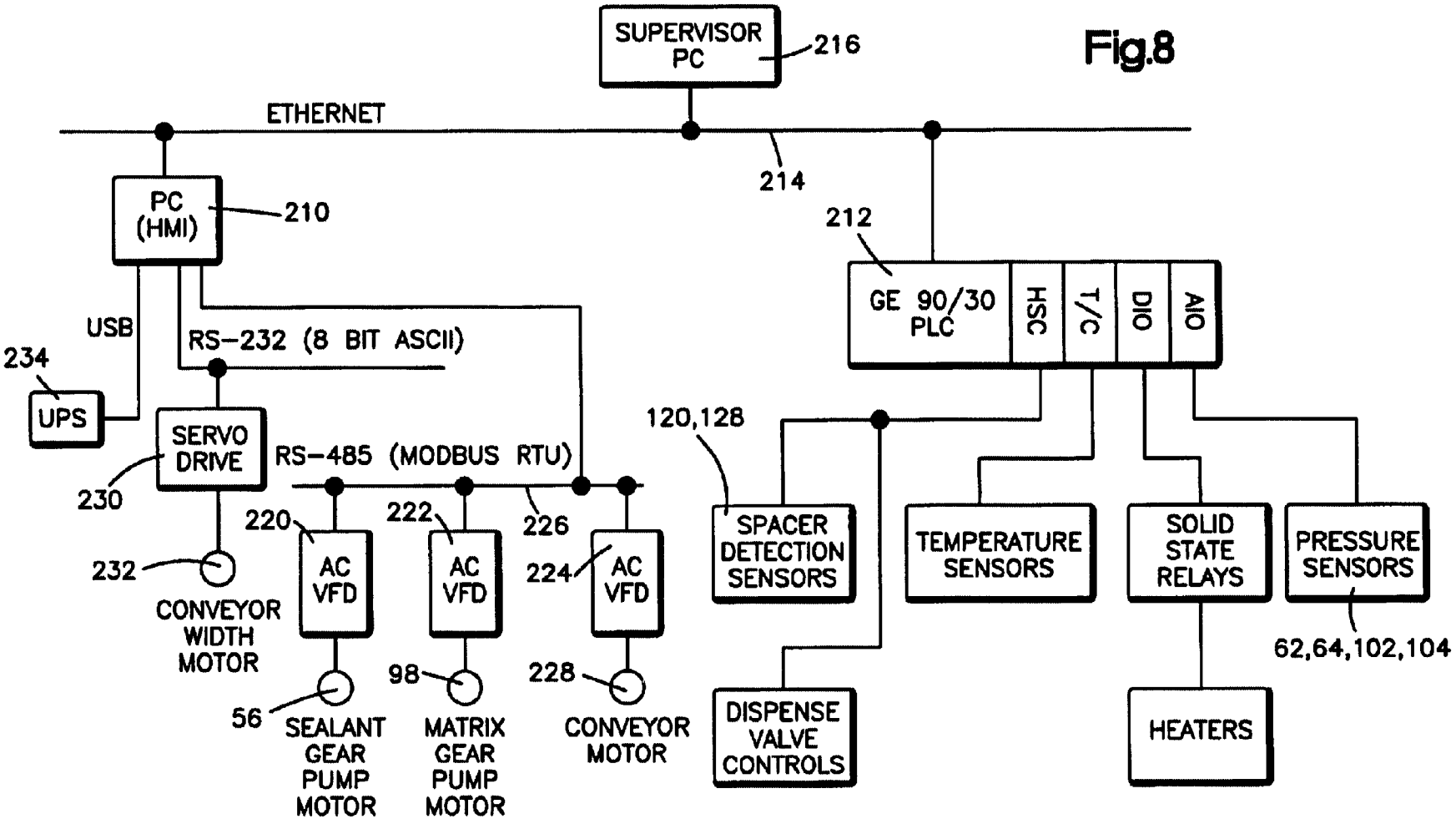
FIG. 8 is a schematic diagram of a control system for controlling application of adhesive and desiccant to spacer assemblies.
Figure 10:
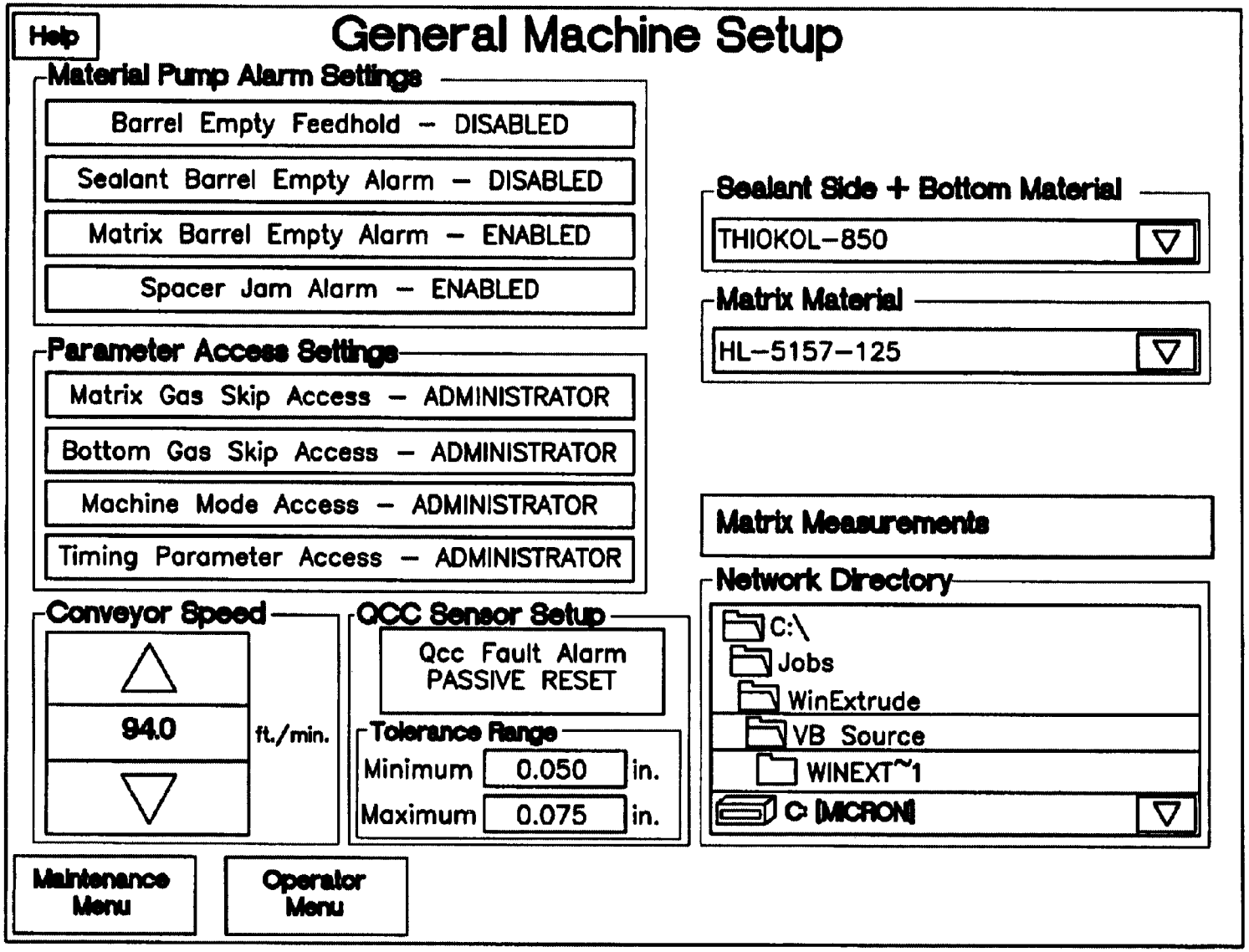
FIG. 10 is a depiction of a video display showing a representative user interface for entering parameters to control the dispensing of desiccant and adhesive; and, FIG. 11 is a depiction of a second video display showing a representative user interface for entering parameters to control the dispensing of desiccant and adhesive.
Figure 11:
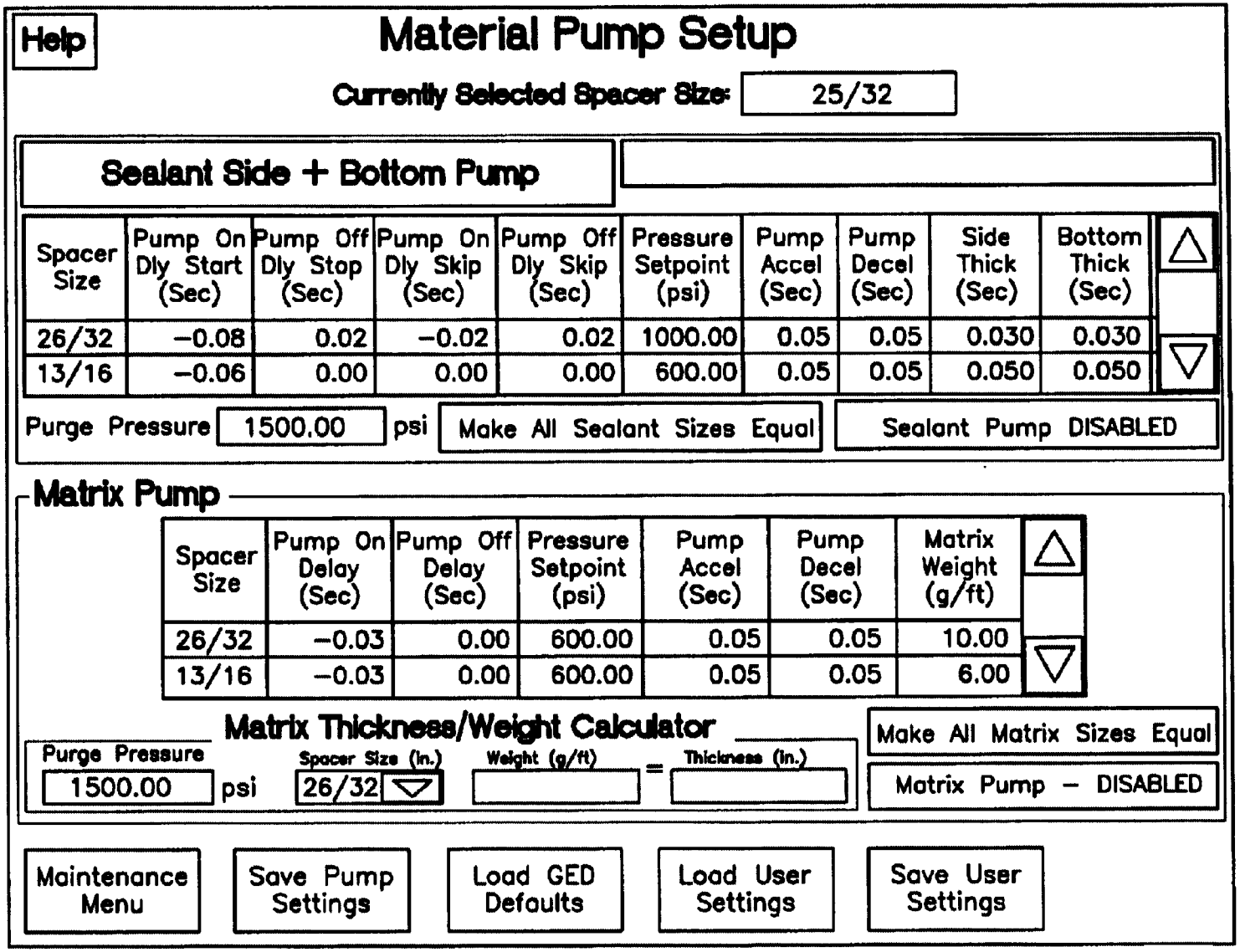

As seen in FIG. 8, the controller 34 includes a personal computer 210 and a programmable logic controller (PLC) 212. The personal computer 210 includes a processing unit that executes a dispensing control program. The personal computer 210 also include an operating system which interacts with the control program and peripherals such as a touch sensitive video display coupled to the personal computer 210. The personal computer 210 is responsible for presenting an operator interface to the user such as seen in FIGS. 10 and 11 which allows the user to enter material application setup parameters, enter machine setup parameters and also display fault and status information to the user.

The programmable logic controller 212 is connected to the personal computer 210 by means of a network 214 which in the present embodiment is an ethernet based network where both the personal computer 210 and the programmable logic controller 212 are nodes on the network. In one embodiment, a supervisor computer 216 manages the network and provides no functionality in operation of the dispensing of material onto a spacer frame. In a typical manufacturing environment there might be multiple programmable controllers and multiple other computers coupled to the network 214 to co-ordinate simultaneous application of material onto multiple spacer frames moving along respective travel paths.

The programmable controller 212 receives data from the personal computer 210, sends fault and machine status back to the computer 210 based on sensed conditions, receives digital and analog information from sensors, and directly controls certain relays and solenoids for coordinated dispensing of desiccant and adhesives.

Three variable speed or variable frequency drive interface circuits 220, 222, 224 are coupled to a RS-485 bus 226 to receive speed control commands from the computer 210. In the exemplary embodiment, the drive interface circuits 220, 222, 224 are sensorless vector-type drive circuits. These drive circuits drive the sealant or adhesive gear pump motor 56, the desiccant gear pump motor 98, and a conveyor motor 228. The circuits 220, 222, 224 provide an interface between these three phase ac motors and the computer 210 by creating a pulse width modulated signal of an appropriate frequency for energizing the motor windings.

A conveyor width servo drive 230 controllably activates a conveyor width motor 232 which moves the guides 118*a*, 118*b* in and out to adjust their separation for different width spacer frames on their travel path along the conveyor 32. The side dispensing guns 58*a*, 58*b* are also moved in and out to accommodate spacer frames having different widths.

Electrical power is supplied to the electronic components that make up the controller 34 (FIG. 8) by a 480 volt three phase alternating current input signal. This power is controlled through a main fusible disconnect power switch. A control transformer (not shown) steps down this 480 volt signal to 120 volts alternating current which is used for supplying power to the programmable logic circuit 212 and an uninterruptible power supply 234 which in turn powers the personal computer 210. Pulse width modulated 480 volt alternating current signals also energize the motors 56, 98, 228.

An emergency stop circuit (not shown) is a hardwired circuit that selectively disconnects power to the variable frequency motors 56, 98, 228 in the event of a failure in any single safety component. A master start sequence must be run by the controller software residing in the personal computer 210 and the PLC 212. The emergency stop circuit enables the system 10 by supplying power to the controller 34 in response to a user pressing a master start push-button. When depressed, the master start push-button will supply power to the system. During operation, in the event any number of safety monitoring sensors senses a problem, the emergency stop circuit removes power from the PLC 212 and the motors 56, 98, 228.

FIGS. 10 and 11 are representative user interface screens 310, 312 that allow the needed parameters to be set up by a user. In FIG. 10 one sees an introductory screen 310 for setting up the system 10. This screen presents the user with a number of control options that can be activated by touching the screen. The options presented in the screen of FIG. 10 are only accessible from a sign in screen (not shown) that is password protected so that only users having specified access privileges can perform the functions outlined in FIG. 10. One function that is controlled by this screen is the conveyor speed in feet per minute units. A drop down list of materials for both the sealant and the desiccant is also accessible from this screen as is the ability to adjust alarm settings and operation modes of the system 10. The user interface 312 shown in FIG. 11 is a more detailed parameter setup screen that allows the operation of the two postitive displacement pumps 24, 26 to be controlled. As seen to the left of this figure, different width spacer frames are allowed and for each such size spacer frame a user having appropriate access rights can program pump operation to achieve proper thickness material application. The text boxes illustrated in FIG. 11 can be selected by pressing against the screen and typing into a keyboard desired values for the chosen parameters.

The personal computer 210 re-calculates the dispensing parameters each time one of the input parameters changes. This in turn causes the personal computer to convey a set of timing counts to the PLC in order to open and close the valves for dispensing material. Input parameters for both adhesive and desiccant are listed below.

Adhesive Input parameters:

- Target Sealant Side Thickness=target side sealant thickness entered by operator.
- Conveyor Speed=speed at which the conveyor is running
- 0.0613465 is the number of liters per cubic inch of material
- spacer width=the width of spacer input into the system by the user
- target Sealant Bottom Thickness=target bottom sealant thickness entered by operator
- 0.1966 is the number of liters per cubic inch multiplied by 12
- Sealant Pump1 Displacement=displacement of the primary sealant pump (fixed at 20.00)
- Sealant Reducer1 Ratio=reducer ratio of the primary sealant pump (fixed at 21.28)
- 60/1750=ratio of the sealant frequency drive (60) and the motor's RPM rating (1750)

Computer Calculations:

- Sealant Side Flow Rate=Target Sealant Side Thickness*Conveyor speed*0.0613465
- Sealant Bottom Flow Rate=Spacer Width*Target Sealant Bottom Thickness*0.1966
- Sealant Total Flow Rate=Sealant Side Flow Rate+Sealant Bottom Flow Rate Sealant Side Pump Speed=(Sealant Side Flow Rate/Sealant Pump1 Displacement)*1000

Sealant Bottom Pump Speed=(Sealant Bottom Flow Rate/Sealant Pump1 Displacement)*1000

Sealant Pump1 Speed=(Sealant Total Flow Rate/Sealant Pump1 Displacement)*1000

Sealant Side Motor Speed=Sealant Side Pump Speed*Sealant Reducer1 Ratio

Sealant Bottom Motor Speed=Sealant Bottom Pump Speed*Sealant Reducer1 Ratio

Sealant Motor1 Speed=Sealant Pump1 Speed*Sealant Reducer1 Ratio

Sealant Side Frequency=(60/1750)*Sealant Side Motor Speed

Sealant Bottom Frequency=(60/1750)*Sealant Bottom Motor Speed

Sealant Motor Frequency=(60/1750)*Sealant Motor1 Speed

Desiccant Input paramters:

Matrix Weight=target matrix weight input by operator

Conveyor speed is the speed conveyor is running

Matrix Density=matrix material density in pounds per gallon

Matrix Pump Displacement=displacement of the matrix pump (fixed at 20.00)

Matrix Reducer Ratio=reducer ratio of the matrix pump (fixed at 21.28)

60/1750=ratio of sealant drive (60) a dn the motor's rpm rating (1750)

Computer Calculations:

Matrix Flow Rate=(Matrix Weight*Conveyor Speed)/Matrix Density

Matrix Pump Speed=(Matrix Flow Rate/Matrix Pump Displacement)*1000

Matrix Motor Speed=Matrix Pump Speed*Matrix Reducer Ratio

Matrix Motor Frequency=(60/1750)*Matrix Motor Speed

These calculations are performed by the computer 210 and converted into timing counts that are sent to the PLC.

PLC Operation

The PLC 212 must detect the presence and absence of the spacer frame, the presence or absence of a gas hole on the spacer frame, and the presence of each corner on the spacer frame. In response to sensing these parameters on each moving spacer frame, the PLC 212 determines when the appropriate nozzles should be opened and closed to apply the material according to the operator's settings such as the representative settings shown in FIGS. 10 and 11. Because of the speed of the conveyor (80–94 feet per minute) the inputs are detected and the logic must be processed fast enough to accurately place the material onto the spacer (+/−0.050" or better).

For these reasons the PLC 212 has two high-speed counter modules that are designed to perform this high-speed logic independent of the PLC program cycle time. One counter is used for the desiccant material control and the other is used for the Sealant material control. The High speed counter modules have several modes of operation. The presently preferred mode does not require a separate encoder device and instead uses an internal counter having a configurable frequency of about 16000 counts per second.

The PLC 212 is coupled to pressure sensors 62, 64, 102, 104 for sensing the pressure of the adhesive and the desiccant. The PLC also monitors optical detectors or sensors 120, 128 at the side of the path of travel of the spacer frame 16. Additionally, control outputs from the PLC open and close the nozzles 58*a*, 58*b*, 60, 114 for dispensing desiccant and adhesive.

Figure 9:
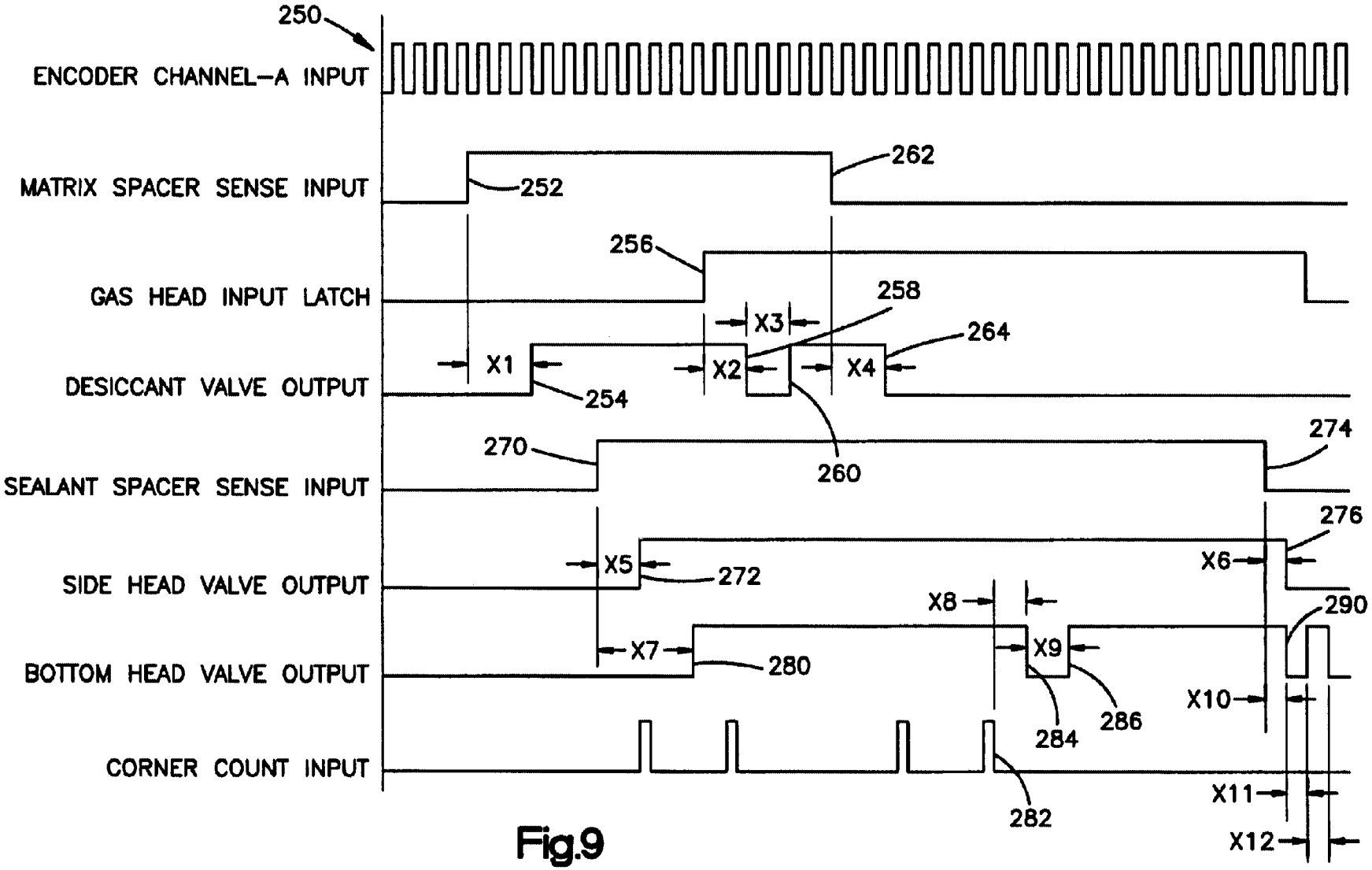
FIG. 9 is a timing diagram showing control of the dispensing of desiccant and adhesive by a programmable logic controller.

FIG. 9 is a timing diagram that illustrates the functionality of the PLC counter. A top most time line shows a sequence of pulses 250 (16,098 counts per second) from a channel A encoder or an internal timer. All Computer calculations (above) done by the computer 210 result in units of counts after factoring in the start/stop points entered in inches or millimeters and the conveyor speed entered in feet/minute. The following control parameters summarized below are depicted on the time line of FIG. 9 and are calculated by the personal computer 210 and transmitted to the PLC 212 for use in performing its control functions.

X1—This parameter is the number of counts between sensing 252 of the leading edge of the spacer frame and a desiccant nozzle output turn on point 254. The sensor 120 senses the leading edge of the spacer 16 to provide the turn on time reference.

X2—This is the number of counts between receipt of a gas hole signal 256 from a sensor above the spacer and turn off 258 of the desiccant output valve in order to skip the gas hole.

X3—This is the number of counts between turning the desiccant valve output off and turning it back on 260 after the gas hole has been skipped.

X4—This is the number of counts between sensing 262 of a spacer trailing edge and turning off 264 of the desiccant output.

The remaining signals relate to timing of the dispensing of the sealant or adhesive.

X5—This is the number of counts between the sensing 270 by the sensor 128 of passage of the leading edge of the spacer frame 16 and the side nozzles for dispensing adhesive being turned on 272.

X6—This is the number of counts between sensing 274 by the sensor 128 of passage of the a trailing edge of the spacer frame 16 turning off 276 the side nozzles.

X7—This is the number of counts between sensing 270 of the leading edge of the spacer frame 16 and opening 280 of a bottom nozzle 60 is to begin delivering adhesive onto a bottom surface of the spacer frame.

X8—This is the number of counts between sensing passage 282 of a third corner notch in the side of the spacer frame 16 and the steps of suspending 284 dispensing from the bottom nozzle 60 in the region of the third corner.

X9—This is the number of counts between the bottom nozzle 60 turning off 284 and turning back on to accommodate passage of a gas hole in the region of the sensed third corner notch.

X10—This is the number of counts between sensing 274 the trailing edge of the spacer frame and turning off 290 of the nozzle 60 that dispenses adhesive against the bottom surface of the spacer frame.

X11—This is the number of counts the bottom nozzle 60 remains off to skip a rivet hole used to assemble the spacer frame once it has exited the system 10.

X12—This is the number of counts the bottom nozzle 60 remains on after skipping the rivet hole in the spacer frame.

These timing diagrams are representative of the operation of the PLC in operating the nozzles in an automatic mode of operation.

Although the present invention has been described with a degree of particularity, it is the intent that the invention include all modifications and alterations falling within the spirit or scope of the appended claims.

We claim:

1. A system for controlled dispensing of a material onto an elongated window component comprising:

a) a nozzle for dispensing the material into contact with a surface of the elongated window component at a delivery site located along a path of travel of the elongated window component;

b) a conveyer for moving the elongated window component along the path of travel relative to the nozzle at a controlled speed;

c) a metering pump for delivering controlled amounts of the material to the nozzle;

d) a bulk supply including a pump mechanism for delivering the material from said bulk supply to an inlet to the metering pump; and, e) a controller for regulating the speed of the metering pump to control the flow rate of the material dispensed by the nozzle.

2. The system of claim 1 further comprising a pressure transducer for monitoring the pressure of the material before said material is dispensed from the nozzle.

3. The system of claim 2 wherein said controller regulates the pressure of the material delivered to the metering pump by the bulk supply pump mechanism based on the pressure sensed by the pressure transducer.

4. The system of claim 2 wherein said pressure of the material delivered to the metering pump by the bulk supply pump mechanism is increased when said pressure sensed by said pressure transducer falls below a threshold value to prevent said metering pump from cavitating.

5. The system of claim 2 wherein said pressure of the material delivered to the metering pump by the bulk supply pump mechanism is decreased when said pressure sensed by said pressure transducer exceeds a threshold value to prevent damage to said metering pump.

6. The system of claim 1 wherein the pressure transducer is positioned for monitoring pressure on an inlet side of the metering pump and wherein said controller includes an output coupled to the bulk supply pump mechanism for adjusting the pressure of said material to minimize a pressure drop between an inlet and an outlet of said metering pump.

7. The system of claim 1 wherein the window component has a substantially closed rectangular shape.

8. The system of claim 1 wherein said nozzle includes first and second orifices for applying first and second types of materials to a side of said elongated window component.

9. The system of claim 8 wherein said first and second types of materials are applied simultaneously.

10. The system of claim 8 wherein said first material is a polyisobutylene material and said second material is a dual seal equivalent material.

11. The system of claim 8 wherein said first and second types of materials are blended as they are dispensed through said nozzle orifices.

12. The system of claim 1 wherein the metering pump is a gear pump.

13. The system of claim 1 additionally comprising an optical sensor for monitoring movement of said elongated window component and wherein the sensor is coupled to the controller to initiate dispensing of material through the nozzle onto the elongated component at an appropriate time based on sensed movement of the elongated window component.

14. The system of claim 13 wherein the elongated window component is a spacer frame member having a gas bleed hole at a location along an elongated extent of the spacer frame and wherein the controller and optical sensor sense a presence of the gas bleed hole and stop material dispensing in a region of the gas bleed hole as the spacer frame moves along the travel path.

15. The system of claim 1 wherein the controller includes a computer interface to allow a user to program parameters relating to a dispensing of the material onto the elongated window component.

16. The system of claim 15 wherein one of said parameters is a width of the elongated window component and wherein the controller responds to an entering of a width parameter by adjusting the metering pump speed to adjust the volumetric flow rate of said material to said nozzle.

17. A system for controlled dispensing of a material onto an elongated window component comprising:

a) a nozzle for dispensing the material into contact with a surface of the elongated window component at a delivery site located along a path of travel of the elongated window component;

b) a conveyer for moving the elongated window component along the path of travel relative to the nozzle at a controlled speed;

c) a metering pump for delivering controlled amounts of the material to the nozzle;

d) a pressurized bulk supply for delivering the material from said bulk supply to an inlet to the metering pump;

e) a controller for regulating the speed of the metering pump to control the flow rate of the material dispensed by the nozzle; and, f) wherein the window component is a generally U shaped spacer frame member and wherein there are first and second nozzles, the first nozzle being adapted to dispense a desiccant into an interior of the spacer frame and the second nozzle for delivery of an adhesive onto an outer surface of the spacer frame.

18. The system of claim 17 wherein there are multiple nozzles for delivering adhesive to outer sides of said U shaped spacer frame.

19. A system for controlled dispensing of a material onto an elongated window component comprising:

a) a nozzle for dispensing the material into contact with a surface of the elongated window component at a delivery site located along a path of travel of the elongated window component;

b) a conveyer for moving the elongated window component along the path of travel relative to the nozzle at a controlled speed;

c) a metering pump for delivering controlled amounts of the material to the nozzle;

d) a bulk supply including a pump mechanism for delivering the material from said bulk supply to an inlet to the metering pump under pressure;

e) a pressure transducer for monitoring the pressure of the material before said material is dispensed from the nozzle; and f) a controller for regulating the pressure of the material delivered to the metering pump by the bulk supply pump mechanism based on a pressure sensed by the pressure transducer.

20. The system of claim 19 wherein the controller includes a computer interface to allow a user to input program parameters relating to a dispensing of the material onto the elongated window component.

21. A system for controlled dispensing of a material onto an elongated window component comprising:

a) a reservoir filled with the material to be dispensed onto the elongated window component;

b) a nozzle for dispensing the material into contact with a surface of the elongated window component at a delivery site located along a path of travel of the elongated window component;

c) a conveyer for moving the elongated window component along the path of travel relative to the nozzle at a controlled speed;

d) a metering pump for delivering controlled amounts of the material to the nozzle;

e) a hose extending between the reservoir and the metering pump for delivering the material from the reservoir to an inlet to the metering pump; and, f) a controller for regulating the speed of the metering pump to control the flow rate of the material dispensed by the nozzle.

* * * * *